US007946901B2

(12) United States Patent
Roberts

(10) Patent No.: US 7,946,901 B2
(45) Date of Patent: May 24, 2011

(54) FIGURINE WITH SELECTABLE AUDIO AND VISUAL PERCEPTION

(76) Inventor: Furn Roberts, Denver, CO (US)

( * ) Notice: Subject to any disclaimer, the term of this patent is extended or adjusted under 35 U.S.C. 154(b) by 0 days.

(21) Appl. No.: 12/883,106

(22) Filed: Sep. 15, 2010

(65) Prior Publication Data

US 2011/0003527 A1 Jan. 6, 2011

Related U.S. Application Data

(63) Continuation-in-part of application No. 11/759,760, filed on Jun. 7, 2007, now abandoned.

(51) Int. Cl.
*A63H 3/12* (2006.01)

(52) U.S. Cl. ..... 446/321; 446/297; 446/372; 40/797; 40/712

(58) Field of Classification Search ..... 446/321, 446/372, 297; 40/712, 797, 796, 793, 655; D6/309

See application file for complete search history.

(56) References Cited

U.S. PATENT DOCUMENTS 669,412 A * 3/1901 Harriman ..... 40/124.5
1,253,803 A * 1/1918 Felsenthal ..... 40/768
1,383,606 A * 7/1921 Davis ..... 362/375
2,199,049 A * 4/1940 Greenberg ..... 446/100
3,407,523 A * 10/1968 Winston ..... 40/1.5
4,020,586 A 5/1977 Benner
4,165,573 A * 8/1979 Richards ..... 40/661
4,573,927 A * 3/1986 Newman ..... 434/236
4,840,602 A 6/1989 Rose
5,045,327 A 9/1991 Tarlow et al.
5,141,466 A 8/1992 Catizone
5,279,514 A * 1/1994 Lacombe et al. ..... 446/297
5,314,336 A 5/1994 Diamond
5,376,038 A * 12/1994 Arad et al. ..... 446/297
5,382,187 A * 1/1995 Wilson ..... 446/391
5,403,224 A 4/1995 Gintling
5,405,266 A 4/1995 Frank et al.
5,676,584 A 10/1997 Perryman
5,738,561 A 4/1998 Pracas
5,842,900 A 12/1998 Hodge
5,848,900 A 12/1998 Pearson
5,947,791 A 9/1999 Taylor
D437,123 S 2/2001 Leon
6,183,338 B1 * 2/2001 Mallette ..... 446/337
6,447,359 B1 9/2002 Crump
D466,565 S 12/2002 Borgaro et al.
6,511,359 B1 * 1/2003 Lui ..... 446/321
6,692,330 B1 * 2/2004 Kulick ..... 446/297
6,810,611 B2 * 11/2004 Yarnall ..... 40/411
6,945,841 B2 9/2005 Becker et al.
2006/0286895 A1 * 12/2006 Thomson et al. ..... 446/297

* cited by examiner

*Primary Examiner* — Gene Kim
*Assistant Examiner* — Matthew B Stanczak
(74) *Attorney, Agent, or Firm* — Roger A. Jackson

(57) ABSTRACT

A figurine and method of use is having selectable personalization includes a doll having a head and torso, also a base disposed adjacent to the head, the base including a surrounding sidewall extending from a bottom portion to an opening defining a first interior that receives a first selected indicia. Further, a transparent cover including an outer periphery that is removably engaged from the sidewall opening. The cover having a first side and second side forming a concave profile to define a second interior portion, with the second side adjacent to the base when the cover and base are engaged, wherein the first and second interior portions form a chamber for the first indicia to be protectively and securely displayed. The base and cover engagement prevents unauthorized removal of the first indicia from the chamber by requiring a tool to separate the base and the cover.

6 Claims, 30 Drawing Sheets

FIGURINE WITH SELECTABLE AUDIO AND VISUAL PERCEPTION

RELATED APPLICATION

This continuation in part (CIP) patent application claims priority from U.S. patent application Ser. No. 11/759,760 filed on Jun. 7, 2007 now abandoned by Furn Roberts of Denver, Colo., US.

TECHNICAL FIELD

The present invention generally relates to figurines that have user selectable features for audio and visual perception to personalize the figurine to a particular individual. More particularly, the present invention is a figurine in the form of a doll that typically includes a theme in the dressing style of the doll, such as astrology for an example which can further customize the doll to a particular individual in addition to a custom recordable electronic audio module and a specific visual image that can be mounted in the dolls face, that enhances an individual's sensory perception in utilizing three of the five human senses from the doll for sight (in the dressing theme and visual image adjacent to the dolls face), sound (in the unique digital audio recording disposed within the doll), and feel (in holding the doll), resulting in an enhanced overall meaning of the doll to the particular individual.

BACKGROUND OF INVENTION

There are many individuals who would benefit the most from a doll having unique specific features that are fitting to a particular individual such as someone in the military, nursing home, children, a special person, spouse, graduate, or even a special occasion and the like, with the doll being typically given as a gift and can either be preprogrammed with a specific audio message and/or visual image by the giver or the doll can be given to the recipient generically, thus allowing the recipient to program their own desired audio message and visual image to the doll. Thus, the doll of the present invention has enhanced meaning to either the owner of the doll or the recipient of the doll with the added sensory perceptions of audio and sight perception uniqueness. This has been partially recognized in the prior art starting with U.S. Pat. No. 6,945,841 to Becker et al., that discloses a customizable doll with interchangeable faces that are removably engaged to the doll head by way of a magnetic sheet having an adhesive on at least one surface for affixing the picture onto, wherein the magnetic sheet is removably engaged to the blank doll face. Becker et al., does suggest the use of a voice recording mechanism and nothing more as to any enabling specifics of the voice recording mechanism such type, the electronics involved, controls, power, positioning, recording times and the like, in addition, Becker et al., of necessity destroys the picture for any other use as adhesive is applied to the photograph making it non removable.

Continuing, in looking at the prior art in this area in U.S. Pat. No. 4,020,586 to Benner disclosed is a doll with a transparent envelope having a single opening at the top of the envelope wherein the doll has a hair piece that covers the envelope opening. The advantage of Benner is in not destroying the picture as does Becker et al., however, the picture only being loosely retained in the envelope slot and subject to dislodging from the envelope slot if the doll were inverted. Further, in U.S. Pat. No. 5,403,224 to Gintling disclosed is a photographic face doll with a removable face pocket that is transparent on both sides and removably engagable to the doll face with an adhesive fastener that allows the face pocket to be reversed for two different pictures to be displayed, in addition the pocket is sealable to prevent the pictures from disengaging from the pocket. Thus, Gintling avoids the shortcomings of Becker et al., destroying the picture or of Benner potentially losing the picture should the doll be inverted. Next, in U.S. Pat. No. 5,676,584 to Perryman disclosed is a doll with interchangeable pre made faces each disposed within a plurality of head slip covers that are removably engagable by a closable hook and loop fastener slit that is vertically positioned at the rear of the head slip cover. The drawback of Perryman is in the need for the multitude of head slip covers adding bulk and cost in addition to the lack of personalization of the facial expression that Becker et al., Benner, and Gintling all accomplish through the use of an actual selected photograph of an individual.

Next, in U.S. Pat. No. 5,848,900 to Pearson disclosed in an educational doll with changeable face elements that are removably engagable from a blank doll face by the use of hook and loop fasteners. However, as in Perryman, Pearson lacks the ability to personalize the facial expression of the doll through the use of an actual selected photograph of an individual by the use of several generic facial expressions created in fabric that are not specific to any particular individual. Continuing, in U.S. Pat. No. 5,947,791 to Taylor disclosed is a replaceable photographic face doll wherein the replaceable face is inserted in the doll's bonnet that has an opening that circumvents the doll's facial opening, with the bonnet's peripheral edge receiving the picture by the use of an elasticized material. Problems with Taylor are in the lack of protection for the photo as it is simply retained on its outer edge where there is exposure to bending, liquids, abrasion, and the like that can result in a high potential for damage to the photo. Further, in U.S. Pat. No. 5,405,266 to Frank et al., disclosed is a method of using a psychotherapeutic doll that has a plurality of interchangeable facial elements that are used to express a patient's emotional state in correspondence with a transparent pocket type backpack wherein an indicia is deposited within the pocket of a time in their life that relates to the emotional state projected onto the doll face. In Frank et al., the faces are attached to the doll head by the use of an elastic band, with the faces being already provided; see FIG. 3, thus true personalization is not really possible of the doll for the user, much the same as in Perryman and Pearson.

Next, in U.S. Pat. No. 5,141,466 to Catizone disclosed is a doll having a facial portion that includes a cut out opening using tape and a drawstring to enclose a photograph that is sandwiched in between a backing material on a back side and a transparent plate on an exposed side. Catizone doesn't really supply a photo protection system as the photo can slide around between the backing and the plate and with the plate being taped to the fabric cut out that makes the photo not easily changeable nor protected from liquids, folding, creasing, and tape adhesive, adding to the potential for damage to the photo, same as in Becker et al., and Taylor. Continuing, in U.S. Pat. No. 5,842,900 to Hodge disclosed is a photo doll that includes a displaceable panel having a predetermined fixed face and disposed underneath the panel is a series of photo holder leaves being similar to a wallet multiple photo holder that is attached to the doll body by a hook and loop fastener. The problem with Hodge is in the photo holder leaves such that when they are exposed, i.e. when the panel is removed the photos in the leaves are not retained meaning that they can slide out of their holders and be lost or damaged see FIGS. 3 and 4, causing problems similar to Benner as previously discussed. Next, in U.S. Design Pat. No. D466,565 to Borgaro et al., disclosed is a doll with a photographic face and template wherein the doll face and template has similar sizing as a matched set, however, as this is a design patent, there is no disclosure as to how the photo is retained or protected. Further, in U.S. design Pat. No. D437,123 to Leon disclosed is a figurine photograph holder, wherein the figurine has a flat round face portion for holding a photograph, and again as in Borgaro et al., there is no disclosure as to how the photo is retained or protected.

Yet further, in looking more towards the talking doll prior art, in U.S. Pat. No. 5,314,336 to Diamond et al., disclosed is a doll that can have an audio output based upon an optical sensing of a selected marker placed in front of the doll thus indirectly enabling the doll to "read and speak" using technology similar to bar code scanning technology, wherein the selected word is coded as a series of scan lines that the doll circuitry can convert to audible sounds with the purpose being for educational learning. Further, in this area of prior art in U.S. Pat. No. 6,447,359 to Crump disclosed is a memorial novelty doll, wherein the doll is of a physical similarity to a person with the doll containing a voice tape recording means disposed within, with the primary purpose being to have a deceased person's voice play back within a doll that has a physical likeness to the deceased person. In looking at a sound module itself, in U.S. Pat. No. 5,045,327 to Tarlow et al., disclosed is a miniature sound module primarily for greeting cards that adds the re-recording feature thus allowing an individual to personalize a recording on the sound module. Continuing, in the talking doll arts in U.S. Pat. No. 5,738,561 to Pracas disclosed is a talking doll that utilizes a digital sound recording module that has as activation points remotely wired to various parts of the doll body, such that one doll hand is squeezed for recording, another doll hand is squeezed for playing back in addition to the combination of touching the doll's hand and leg for activation/deactivation of the voice module, also with an "on" light appearing as an earring on the doll. Also, in U.S. Pat. No. 4,840,602 to Rose a talking doll is disclosed that is responsive to an external signal allowing a conversation with the doll by use of radio signals to activate the dolls programmed response.

What is needed is a doll that can be personalized to a particular individual eliciting responses from multiple human senses to enhance the experience to the possessor of the doll. This can be accomplished through customizable audio output of the doll in conjunction with a selected visual image for the doll face, wherein the picture is protected from the external environment, is not damaged at all in its transparent enclosure, and is only replaceable with a special tool to protect from inadvertent removal of the visual image from its protectable holder, however with the visual image not having any permanent damage from residing in its protectable holder. In addition, the doll can have an overall image or theme associated with it related to the doll's clothing that can further personalize the doll's affiliation with a particular individual by pleasurably stimulating the senses of sight, sound, and touch.

SUMMARY OF INVENTION

Broadly, the present invention is a figurine that is capable of selectable personalization that includes a doll having a head portion and a torso portion, further included in the figurine is a substantially rigid base that is disposed adjacent to the head portion, the base including a surrounding sidewall extending from a bottom portion to an opening. The bottom portion and sidewall of the base defining a first interior portion that is sized and configured to receive a first substantially planar selected indicia. Also included in the figurine is a substantially rigid transparent cover including an outer peripheral portion that is adapted to be removably engaged from the sidewall opening. The cover having a first side and a second side, the second side forming a substantially concave profile to define a second interior portion, with the second side adjacent to the base when the outer peripheral portion and the opening are manually engaged. The manual engagement forming an assembled and locked state for the base and cover, wherein the first interior portion and the second interior portion form a substantially rigid chamber for the first planar selected indicia to be substantially protectively and securely displayed within the substantially rigid chamber. The substantially rigid chamber is sized and configured such that the first selected indicia does not have to be attached to the base or the cover to help prevent damage to the selected indicia. As the removable engagement between the base opening and the cover peripheral portion is operational to prevent unauthorized removal of the selected first indicia from the substantially rigid chamber by requiring an independent tool to separate the base and the cover into a disassembled unlocked state to remove or replace the first selected indicia to further enhance security of the assembled state.

These and other objects of the present invention will become more readily appreciated and understood from a consideration of the following detailed description of the exemplary embodiment(s) of the present invention when taken together with the accompanying drawings, in which;

REFERENCE NUMBERS IN DRAWINGS

Figure 1:
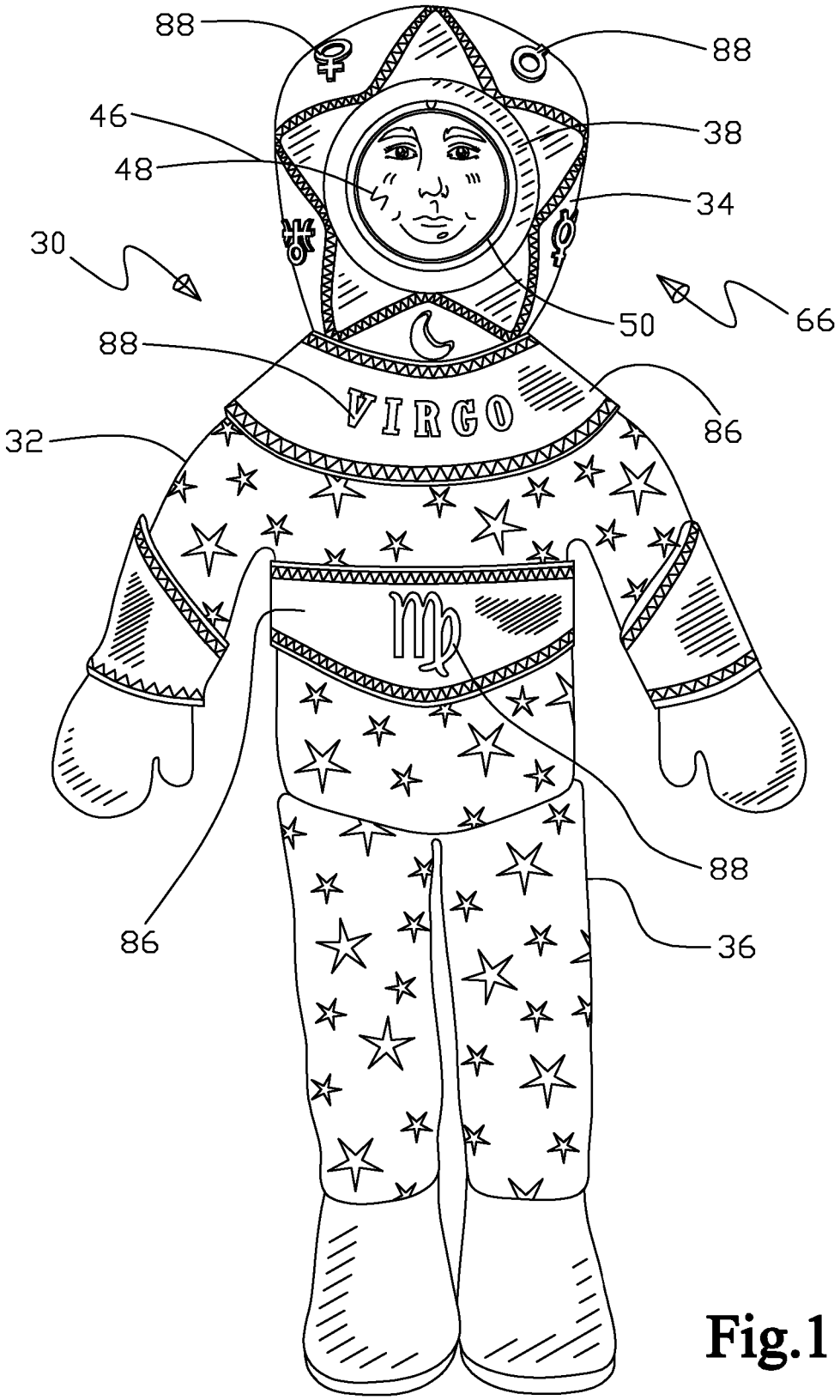
FIG. 1 shows a front view of the figurine with a second selected indicia having specific astrological indications.

30 Figurine
32 Doll
34 Head portion of doll 32
36 Torso portion of doll 32
38 Base
39 Bottom portion of base 38
40 Surrounding sidewall of base 38
41 Inner diameter of opening 42 of surrounding sidewall 40 preferably dimensioned at about 2.256 inches
42 Opening of surrounding sidewall 40
43 Distance or size of opening 42 of surrounding sidewall 40
44 First interior portion of base 38
46 First substantially planar selected indicia
48 Selected picture/photo image
50 Cover
51 Longitudinal axis
52 Outer peripheral portion of cover 50
53 Outer periphery of cover 50
54 Distance or size of outer periphery 53 of cover 50
55 Outside diameter of cover 50 preferably dimensioned at about 2.260 inches
56 Removable engagement of opening 42 and outer peripheral portion 52
58 First side of cover 50
59 Angle between tool 70 and first side 58 of the cover 50 preferably about 130 degrees
60 Second side of cover 50
62 Substantially concave profile of cover 50
64 Second interior portion of cover 50
66 Assembled and locked state for base 38 and cover 50
68 Rigid chamber for assembled 66 base 38 and cover 50
70 Tool in the form of a key
72 Separation of base 38 and cover 50 into a disassembled and unlocked state
74 Remove and replace of the first selected indicia 46 or picture 48
76 Interference fit of removable engagement 56 as between outer diameter 55 and inner diameter 41
78 Key slot and interior in cover 50
80 Disengaging of cover 50 from base 38 by the tool 70 to disengage removable engagement 56
82 Apertures therethrough in base 38
84 Stitching utilizing apertures 82
86 Selected second indicia
88 Specific astrological indications
90 Positioning the cover 50 second side 60 to face the selected picture/photo image 48
92 Pressing the cover 50 toward the base 38
298 Means for a selectable audio recording
300 Audio module assembly
302 Housing for the audio module 300
304 Power supply for the audio module 300
305 Batteries for the power supply 304
306 Microphone for the audio module 300
308 Actuation control for the audio module 300
310 Mode selector switch for the audio module 300
312 Function selector switch for the audio module 300
314 Digital recorder integrated circuit IC chip for the audio module 300
316 LED indicator for the audio module 300
318 Output speaker for the audio module 300
320 Electrical communication for the power supply 304
322 Digital ground for the audio module 300
324 Analog ground for the audio module 300
326 Speaker positive (+) ground for the audio module 300
328 Speaker negative (−) ground for the audio module 300
330 1 kilo ohm resister for LED 316
332 0.1 micro farad capacitor to ground 322 for IC chip 314 reset

334 Voltage supply for IC chip 314 and LED 316
336 Voltage supply for microphone 306 and IC chip 314
338 Voltage supply for speaker 318 and IC chip 314
340 0.1 micro farad capacitor for voltage supply 334
342 4.7 micro farad capacitor for voltage supply 334
344 0.1 micro farad capacitor for voltage supply 336
346 4.7 micro farad capacitor for voltage supply 336
348 0.1 micro farad capacitor for voltage supply 338 for speaker positive (+)
350 4.7 micro farad capacitor for voltage supply 338 for speaker positive (+)
352 0.1 micro farad capacitor for voltage supply 338 for speaker negative (−)
354 4.7 micro farad capacitor for voltage supply 338 for speaker negative (−)
356 8 kilo ohm resister for oscillator resister for IC chip 314 timing duration
358 4.7 micro farad capacitor for microphone 306 gain (preamplifier)
360 4.7 kilo ohm resister for voltage 336 control of the microphone 306
362 4.7 kilo ohm resister for voltage 336 control of the microphone 306
364 4.7 kilo ohm resister for voltage switch combination 308, 310, and 312 controls to record pin 24 of the IC chip 314 to supply microphone 306 power only when audio module assembly 300 is in record mode to save power at other times
366 4.7 micro farad capacitor voltage supply 336 to ground 324
368 0.1 micro farad capacitor between microphone 306 and mic+ pin 10 on IC chip 314
370 0.1 micro farad capacitor microphone 306 and mic− pin 11 on IC chip 314
400 Disposing of electronic audio module 300 in torso portion 36
402 Squeezing actuation/de-actuation control 308 exterior to the torso portion 36
404 Removing the torso portion 36 from the electronic audio module 300
450 Pry from behind or from interference fit 76—or anywhere outside of the key slot 78
455 Radial depth of key slot 78 preferably dimensioned at about 0.08 inches
460 Wall thickness between key slot 78 and cover diameter 470 preferably dimensioned at about 0.05 inches
465 Thickness of cover 50 preferably dimensioned at about 0.1 inches
470 Inner diameter at concave 62 preferably dimensioned at about 2.0 inches
471 Depth at concave 62 preferably dimensioned at 0.04 inches, wherein typical paper photos 48 are about 0.01 inches thick
475 Base circle diameter of apertures 82 preferably dimensioned at about 2.5 inches
476 Hole diameter of aperture 82 preferably dimensioned at about 0.03 inches
480 Outside diameter base 38 and surrounding sidewall 40 preferably dimensioned at about 2.7 inches
485 Wall thickness of diameter 41 to outside diameter 480 preferably dimensioned at about 0.222 inches
490 Thickness of the base 38 preferably dimensioned at about 0.205 inches
495 Depth of the opening 42 preferably dimensioned at about 0.141 inches
505 Width of key slot 78 preferably dimensioned at about 0.05 inches
510 Tangential radius of key slot 78 preferably dimensioned at about 0.025 inches
511 Radial axis of radius 510
515 Complementary angle to angle 59 preferably at about 50 degrees
520 Movement force of tool 70 to move from the assembled state 66 to the separated state 72 or disengagement 80
525 Receiving recess and key slot 78 disposed in radius 510
526 Depth of the receiving recess 525 preferably dimensioned at about 0.03 inches
527 Indentation depth of receiving recess 525 preferably dimensioned at about 0.02 inches
530 Pivot point for key 70 in base 38 surrounding sidewall 40
535 Longitudinal axis of key 70
536 Length of key 70 preferably dimensioned at about 1.0 inches
537 Width of key 70 preferably dimensioned at about 0.04 inches
538 End portion of key 70 sized and configured to be received into recess 525 at indentation 527 at position 526 along the radial axis 511
540 Knife
545 Screwdriver
550 Movement of tool 70 along opening 42

DETAILED DESCRIPTION

Figure 2:
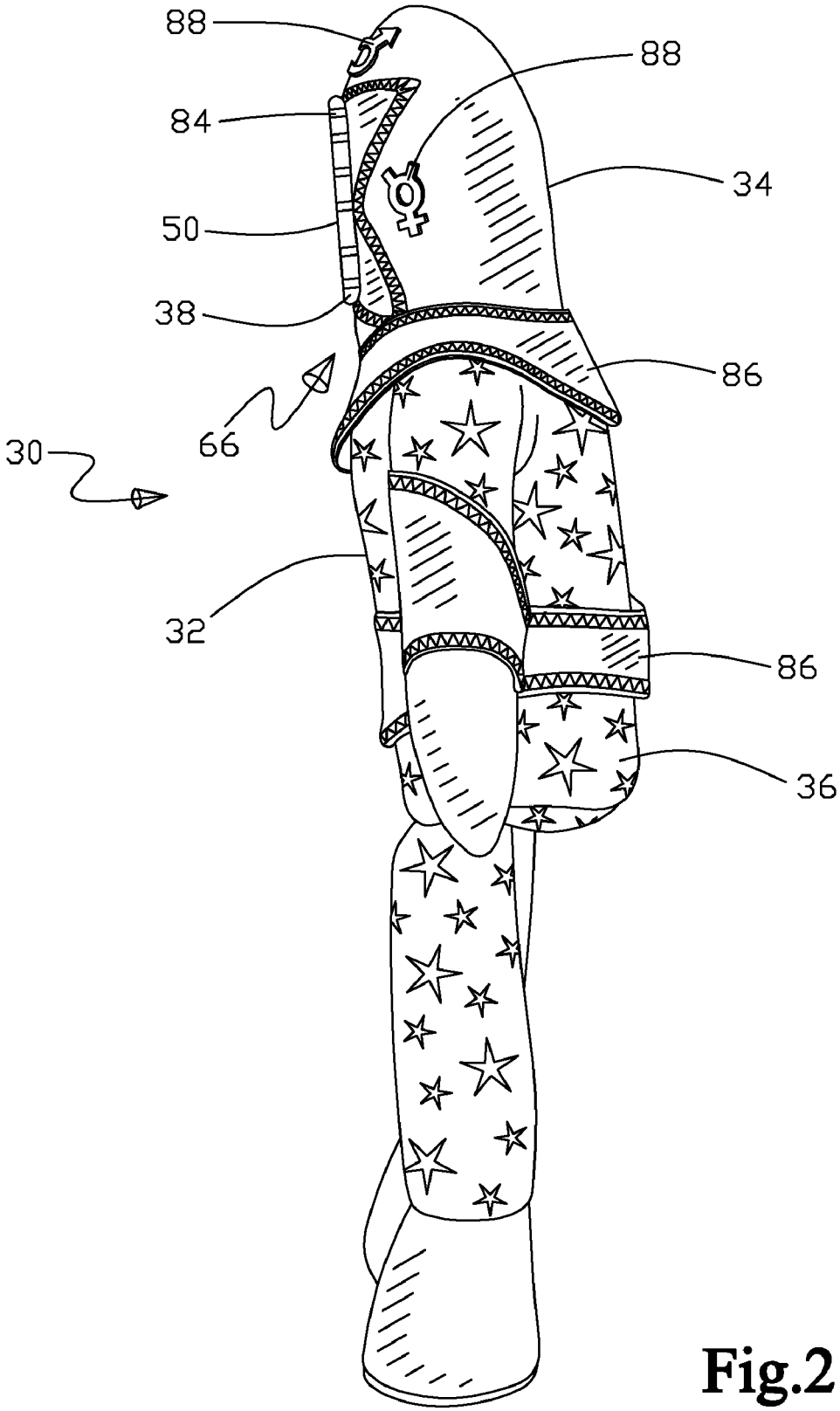
FIG. 2 shows a side view of the figurine with the second selected indicia having specific astrological indications.
Figure 3:
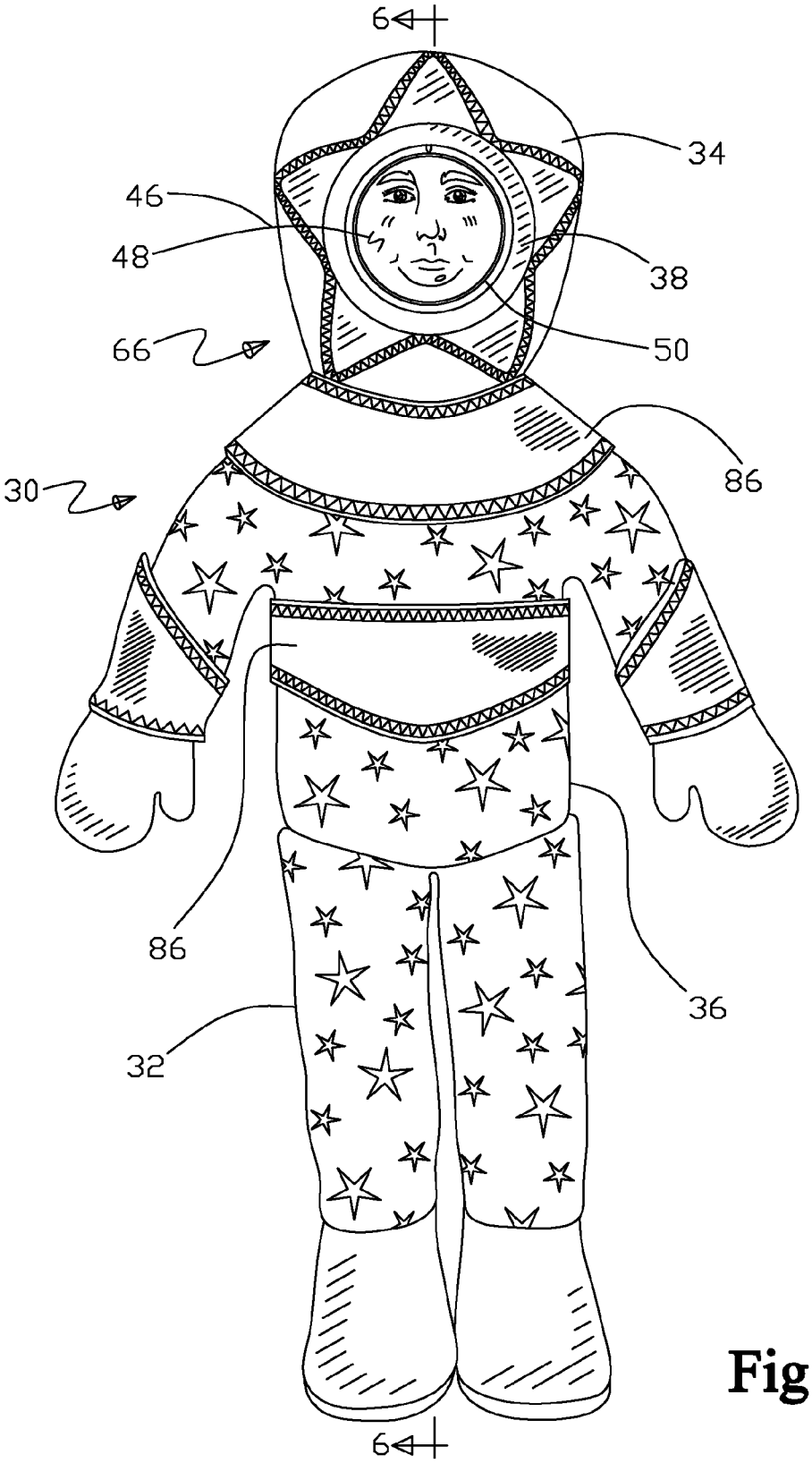
FIG. 3 shows a front view of the figurine with a second selected indicia without specific astrological indications.
Figure 4:
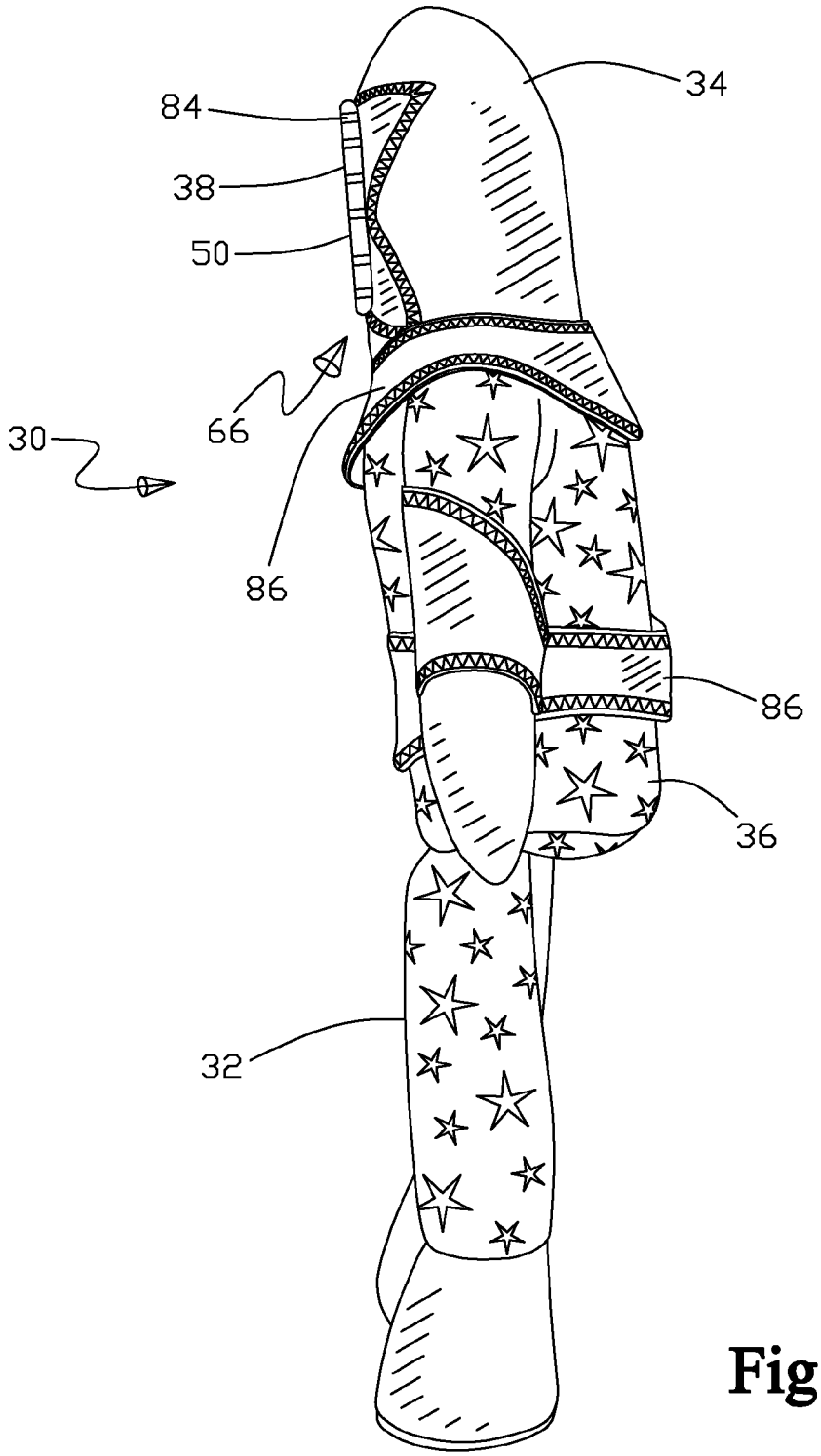
FIG. 4 shows a front view of the figurine with the second selected indicia without specific astrological indications.
Figure 5:
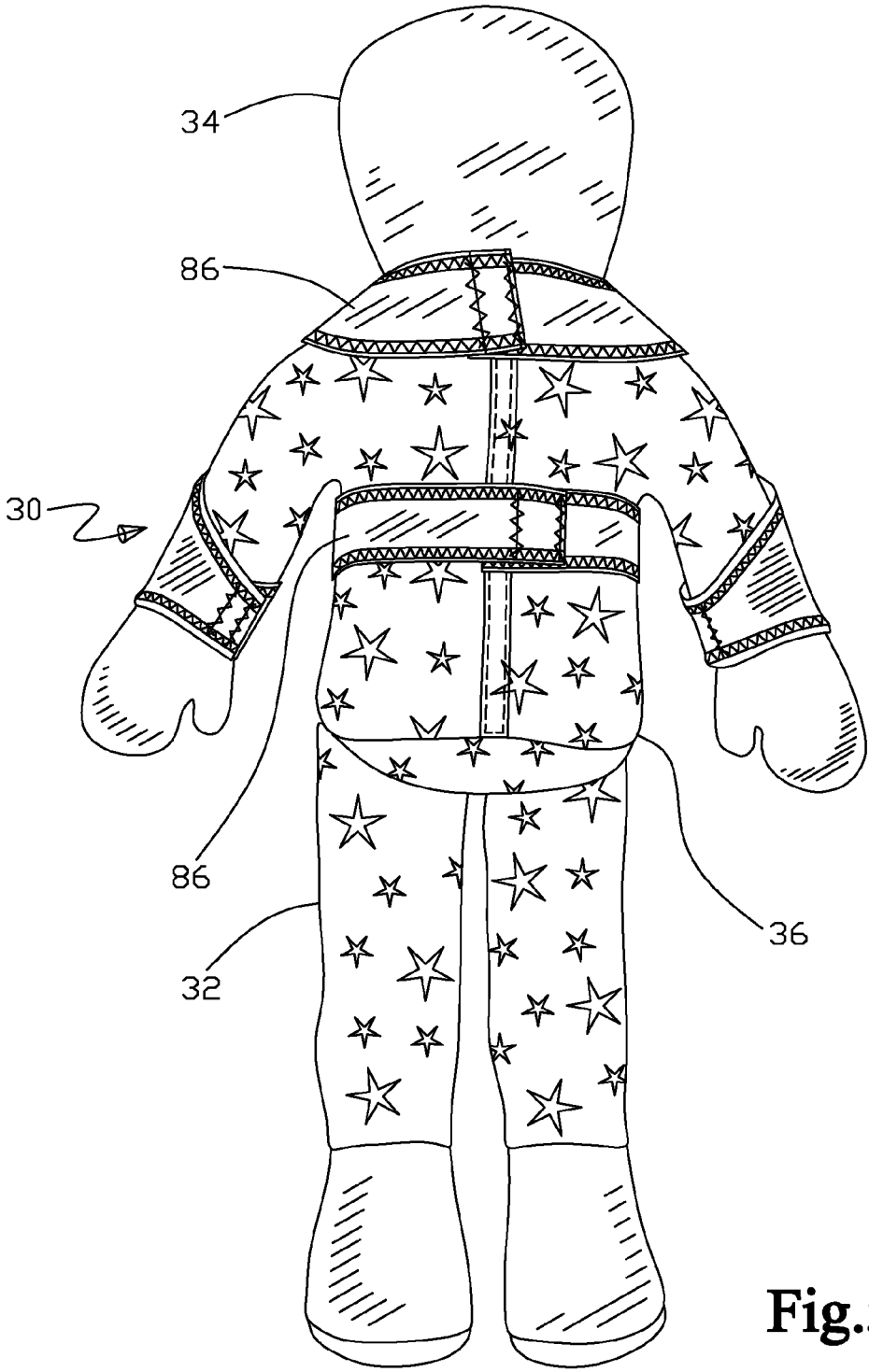
FIG. 5 shows a rear view of the figurine with the second selected indicia without specific astrological indications.
Figure 6:
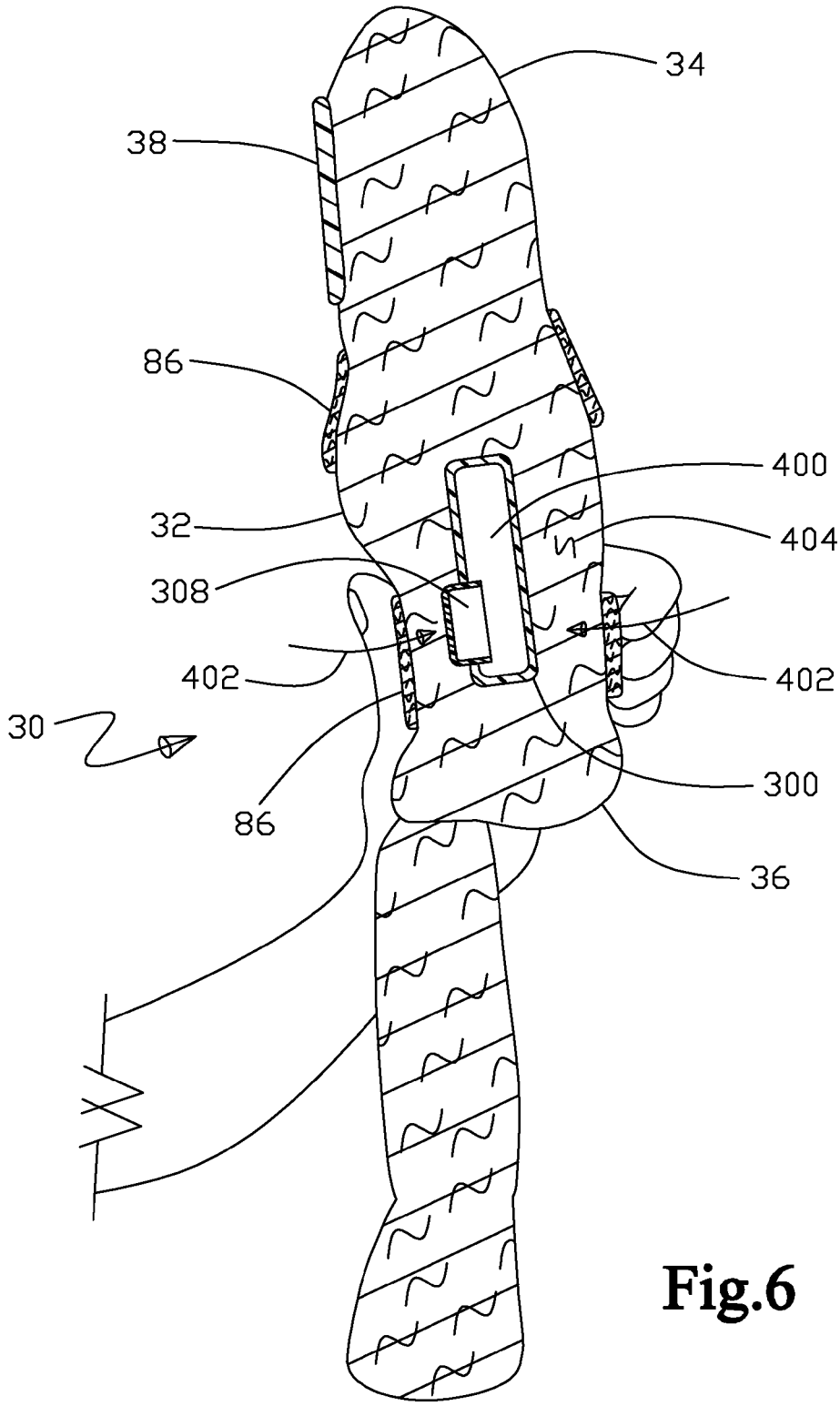
FIG. 6 shows a cross sectional view 6-6 from FIG. 3 of the figurine specifically showing the means for selectable audio recording disposed within the torso portion of the doll.

With reference to FIG. 1 shown is a front view of the figurine 30 in the form of a doll 32 with a second selected indicia 86 having specific astrological indications 88, FIG. 2 shows a side view of the figurine 30 with the second selected indicia 86 having specific astrological indications 88, and FIG. 3 shows a front view of the figurine 30 with a second selected indicia 86 without specific astrological indications 88. Further, continuing FIG. 4 shows a front view of the figurine 30 with the second selected indicia 86 without specific astrological indications 88, FIG. 5 shows a rear view of the figurine 30 with the second selected indicia 86 without specific astrological indications 88, and FIG. 6 shows a cross sectional view 6-6 from FIG. 3 of the figurine 30 specifically showing the means 298 for selectable audio recording disposed within the torso portion 36 of the doll 32.

Figure 7:
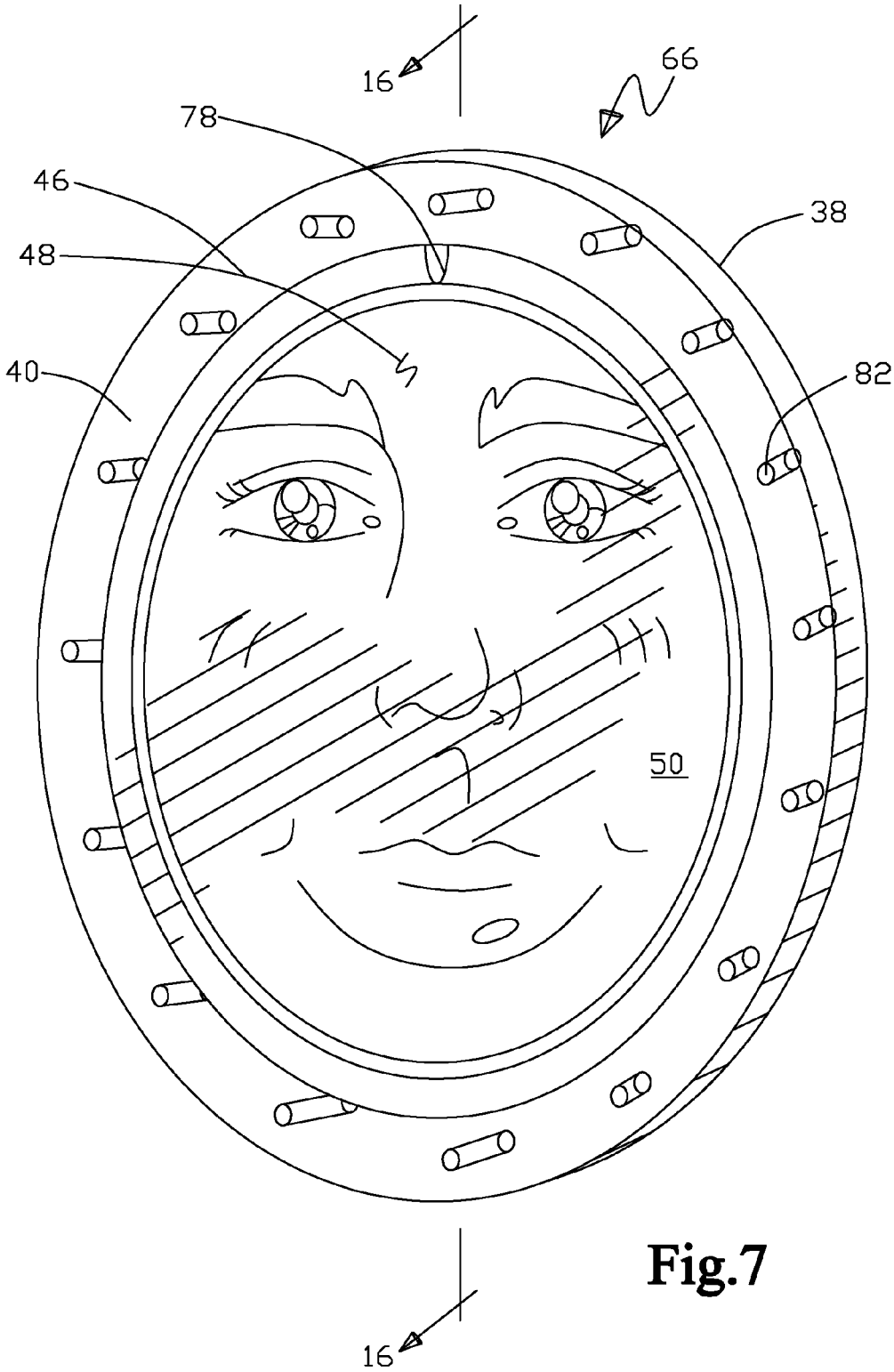
FIG. 7 shows a close up perspective view of the base and cover assembled in a assembled and locked state with the first selected indicia or selected photo disposed therebetween.
Figure 8:
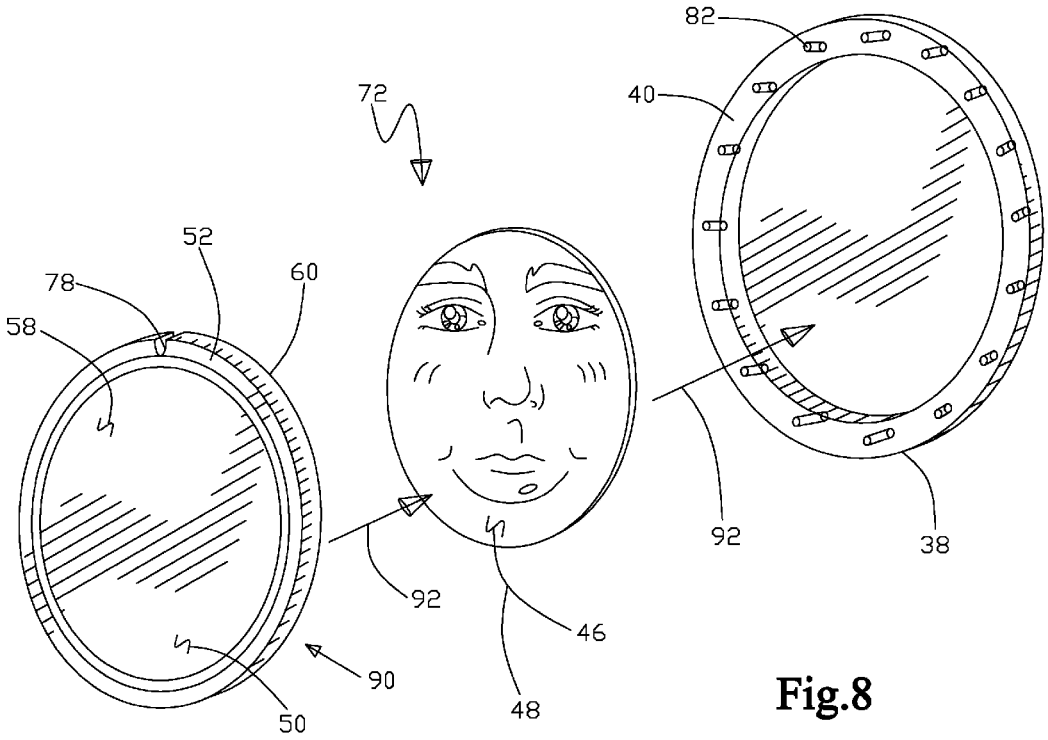
FIG. 8 shows an exploded perspective view of the cover, the first selected indicia or selected photo, and the base.
Figure 9:
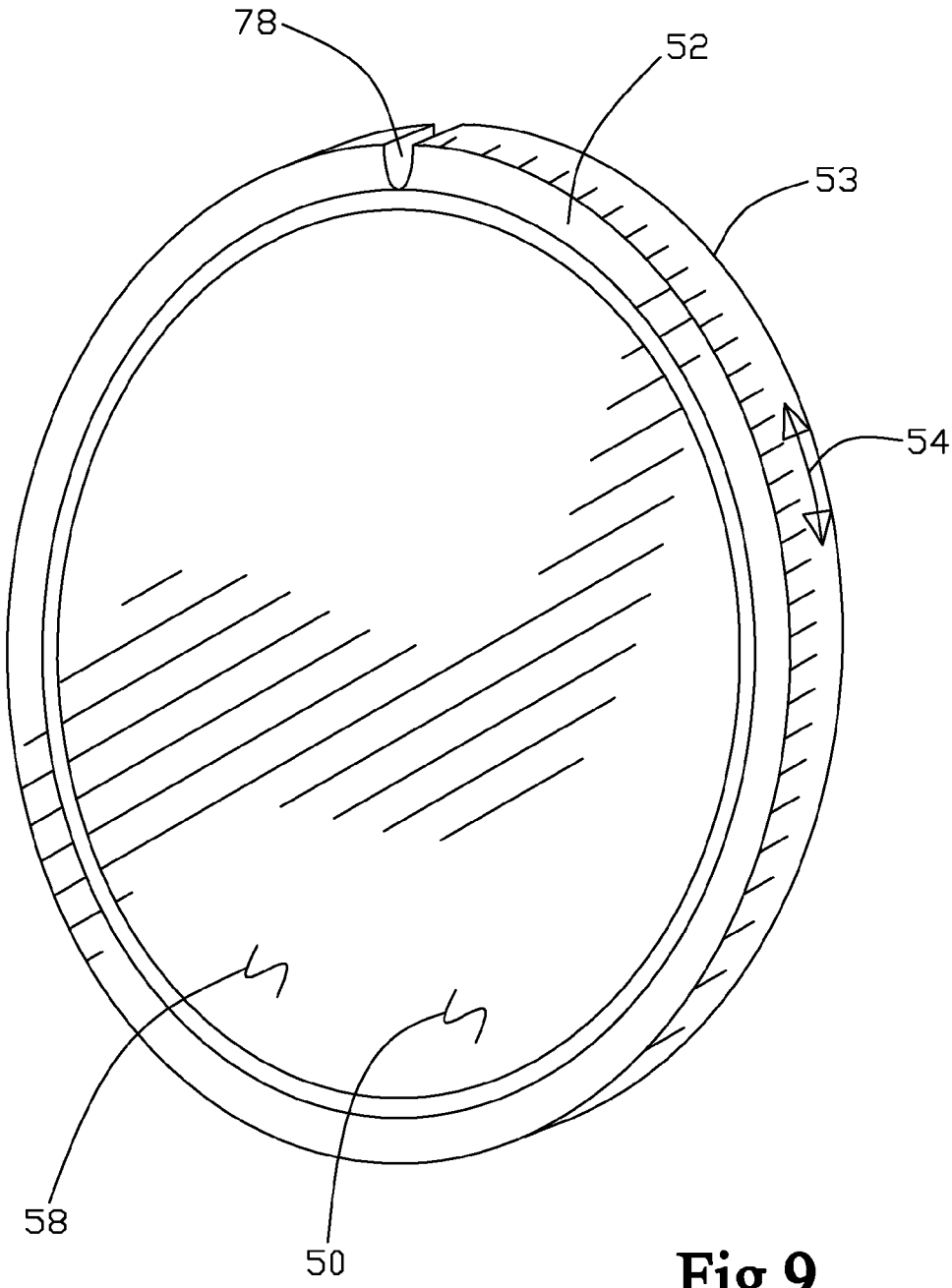
FIG. 9 shows a perspective view of the cover.
Figure 10:
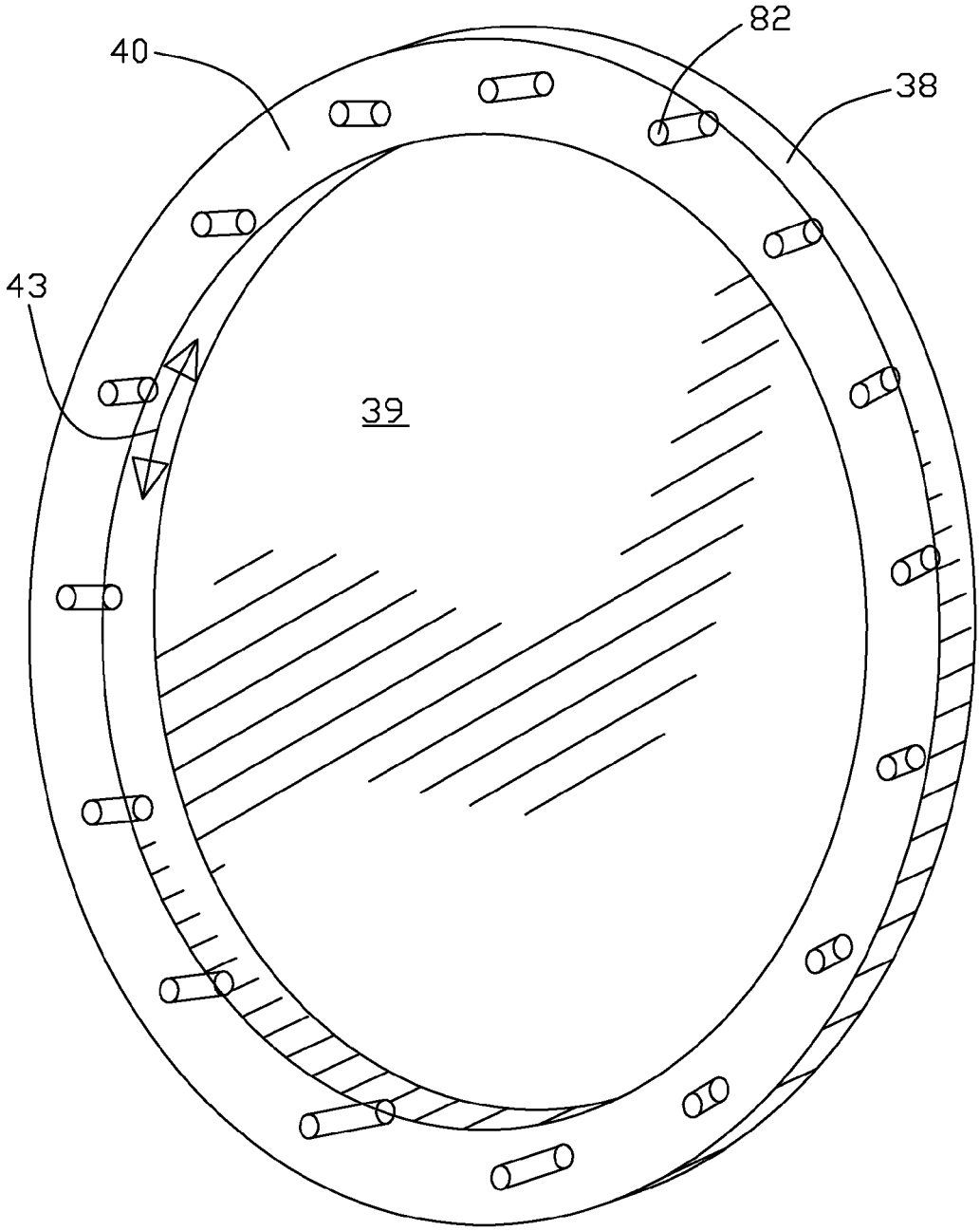
FIG. 10 shows a perspective view of the base.
Figure 11:
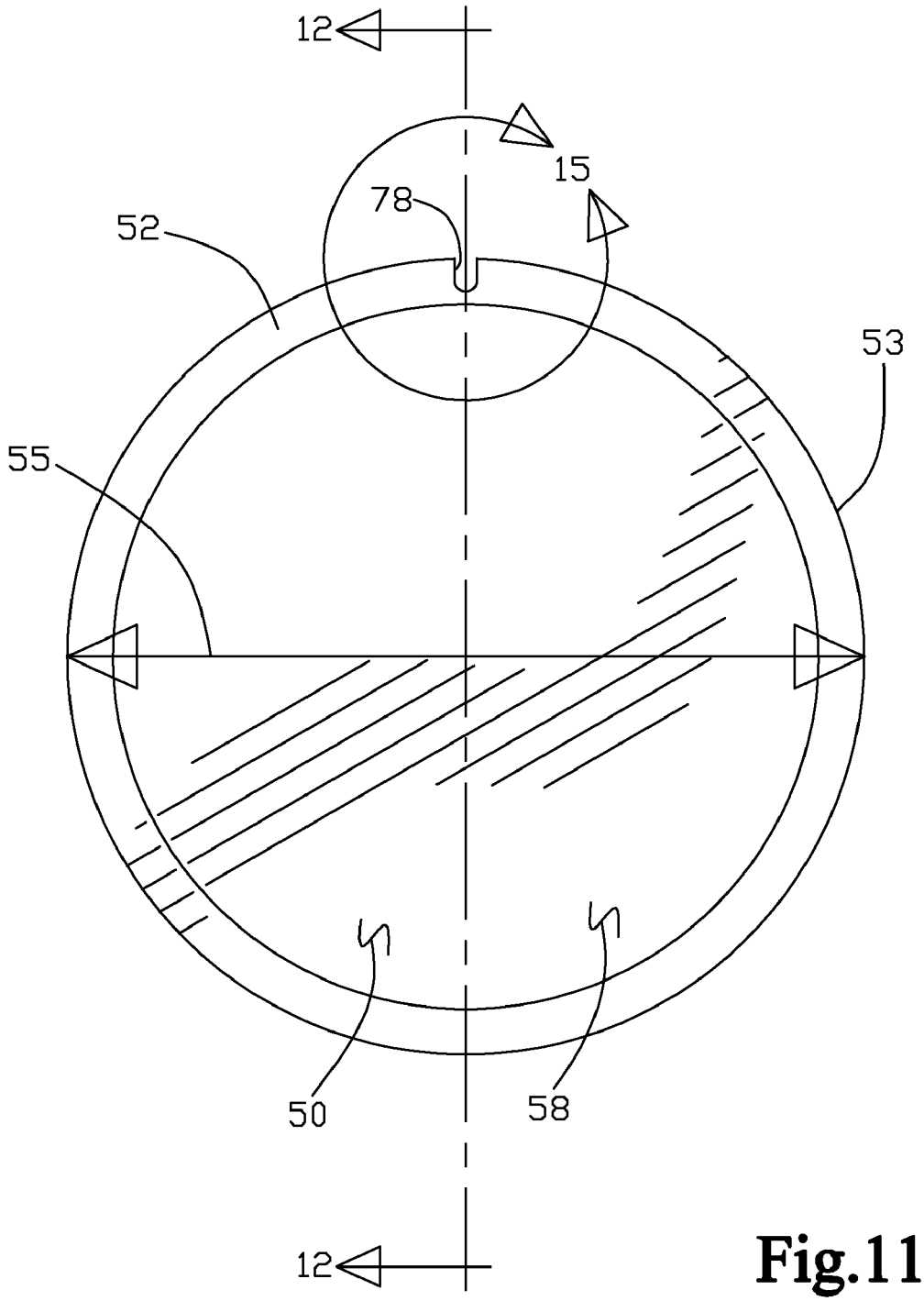
FIG. 11 shows a front view of the cover.
Figure 12:
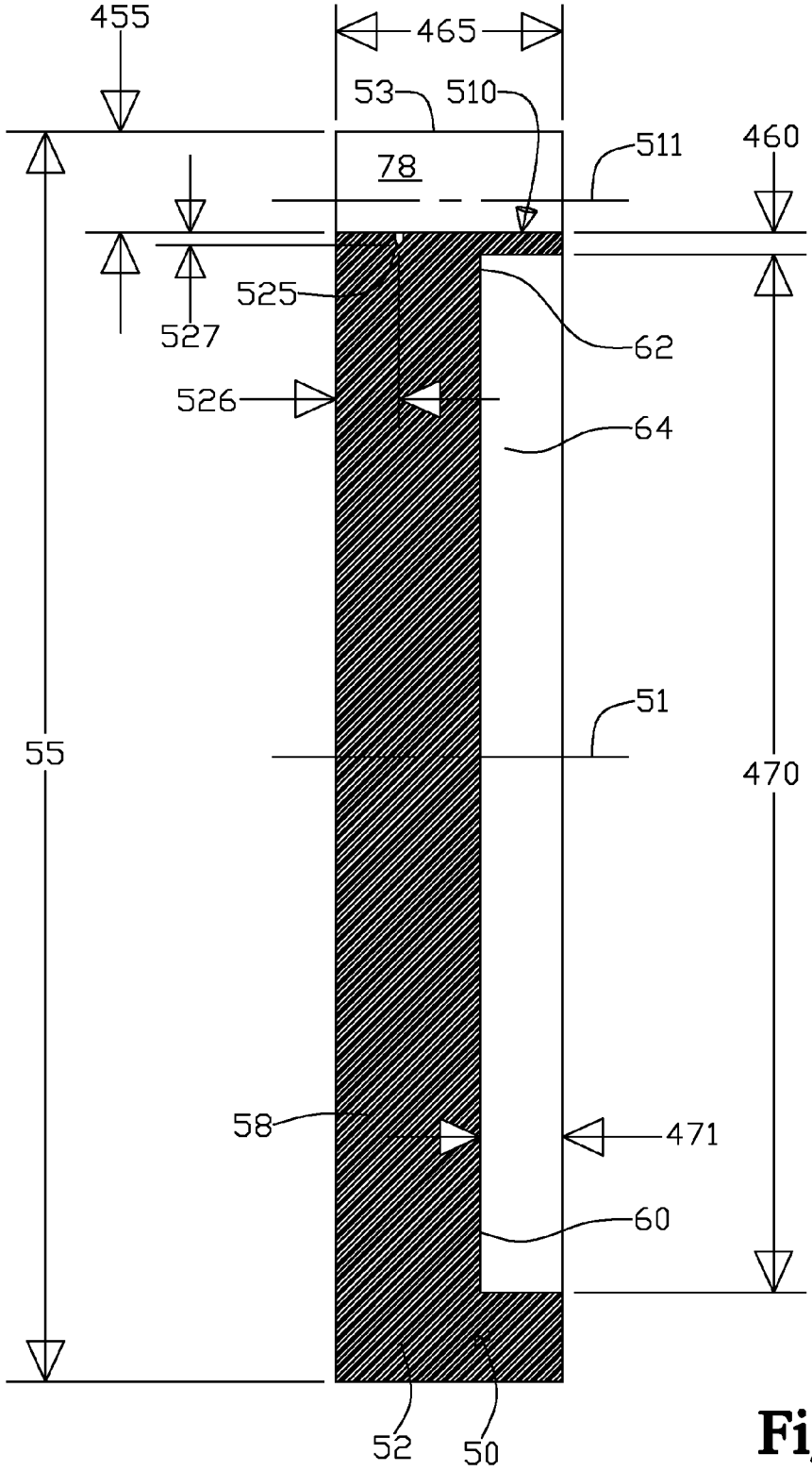
FIG. 12 shows cross section 12-12 from FIG. 11 of the cover that includes the key slot, the key slot depth, the key slot length or cover thickness, the wall thickness between the key slot and diameter of the concave profile, the receiving recess, the receiving recess depth. and the concave profile depth.
Figure 13:
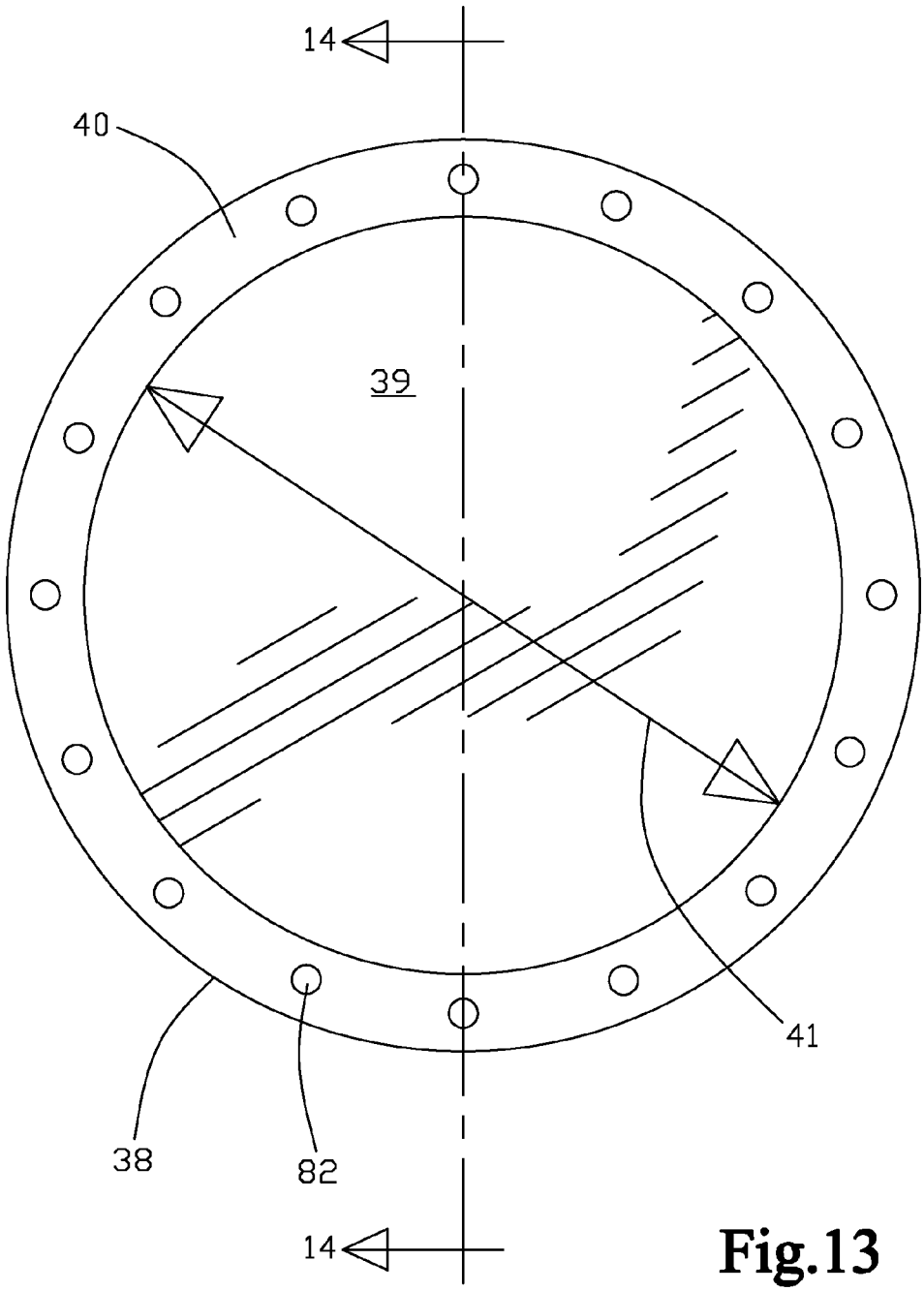
FIG. 13 shows a front view of the base with the apertures and diameter of the base opening.
Figure 14:
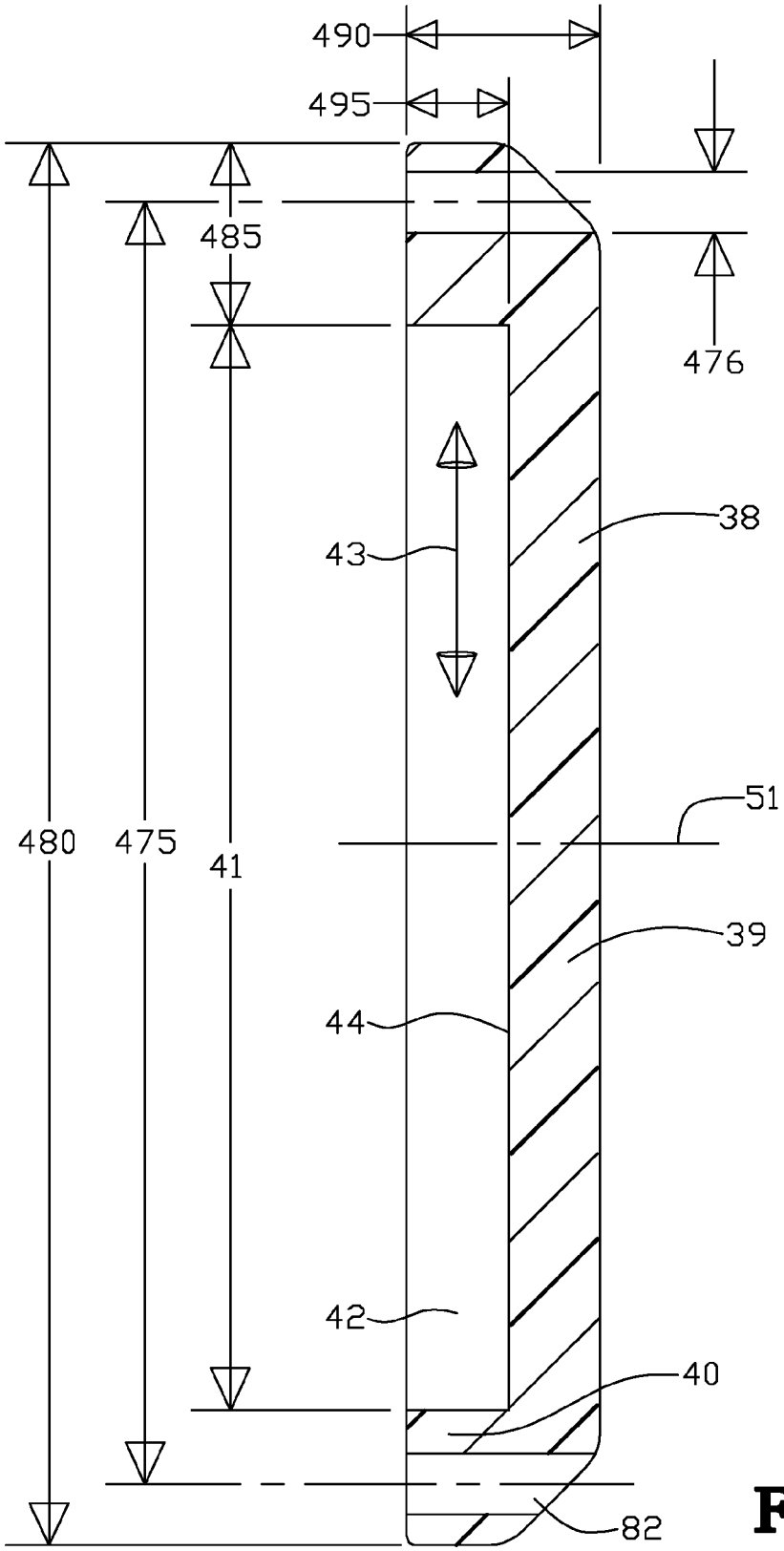
FIG. 14 shows cross section 14-14 from FIG. 13 of the base that includes the outside diameter, the thickness, the apertures, the apertures base circle diameter, the aperture size, the opening diameter, and the opening depth.
Figure 15:
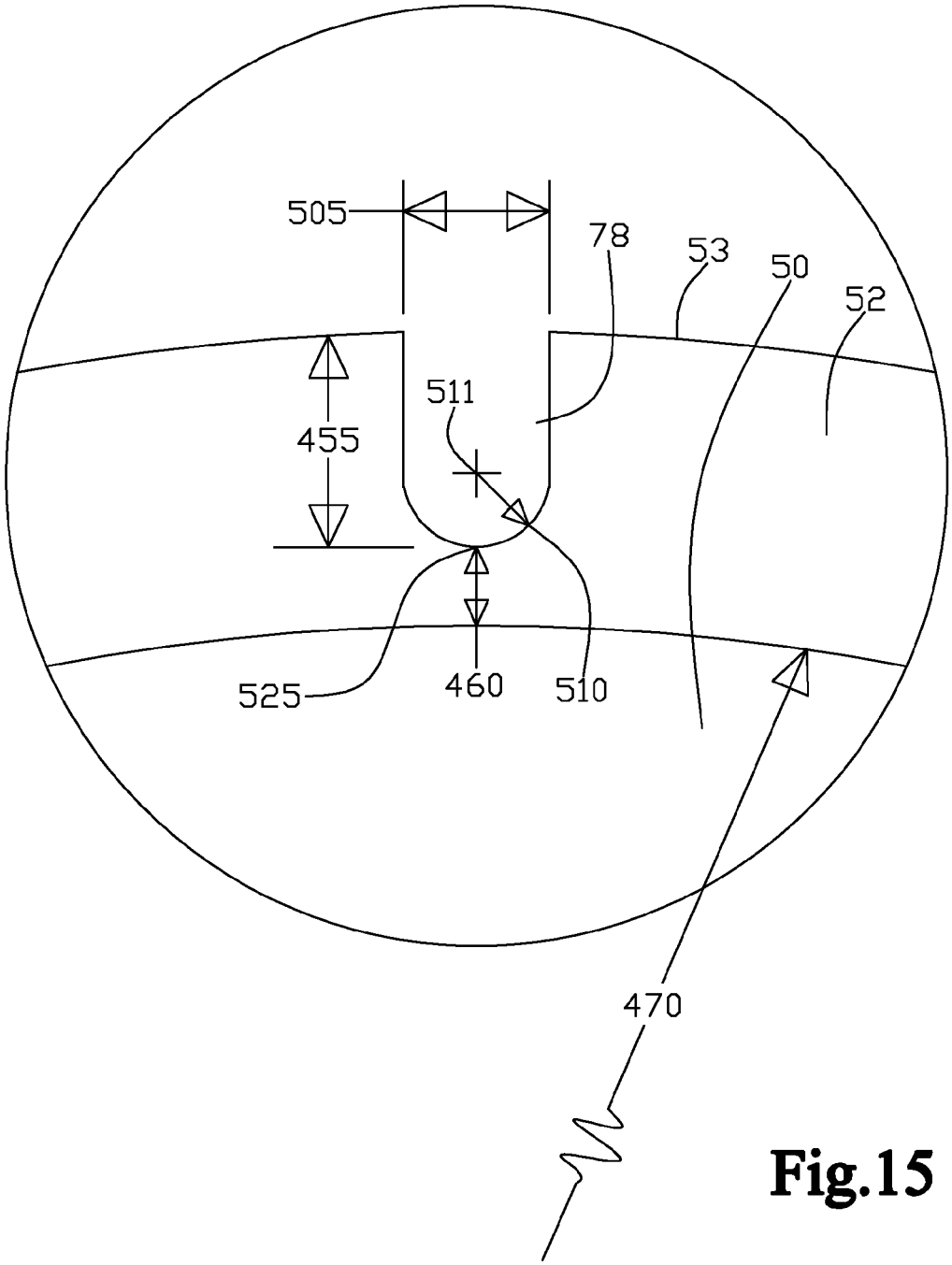
FIG. 15 is expanded view 15-15 from FIG. 11 showing detail of the key slot width, key slot depth, key slot root radius, the receiving recess disposed in the root radius, and the wall thickness between the key slot root radius, and the diameter of the concave profile.

Next, FIG. 7 shows a close up perspective view of the base 38 and cover 50 assembled in a assembled and locked state 66 with the first selected indicia 46 or selected photo 48 disposed therebetween, FIG. 8 shows an exploded perspective view of the cover 50, the first selected indicia 46 or selected photo 48, and the base 38, and FIG. 9 shows a perspective view of the cover 50. Moving onward, FIG. 10 shows a perspective view of the base 38. FIG. 11 shows a front view of the cover 50 and FIG. 12 shows cross section 12-12 from FIG. 11 of the cover 50 that includes the key slot 78, the key slot depth 455, the key slot length or cover thickness 465, the wall thickness 460 between the key slot 78 and diameter 470 of the concave profile 62, the receiving recess 525, the receiving recess depth 527, and the concave profile depth 471;

Further, FIG. 13 shows a front view of the base 38 with the apertures 82 and diameter of the base opening 41 and FIG. 14 shows cross section 14-14 from FIG. 13 of the base 38 that includes the outside diameter 480, the thickness 490, the apertures 82, the apertures base circle diameter 475, the aperture size 476, the opening diameter 41, and the opening depth 495. Next, FIG. 15 is expanded view 15-15 from FIG. 11 showing detail of the key slot 78 width 505, key slot depth 455, key slot root radius 510, the receiving recess 525 disposed in the root radius 510, and the wall thickness 460 between the key slot root radius 510 and the diameter 470 of the concave profile 62. Continuing, FIG. 16 shows cross section 16-16 from FIG. 7 detailing out the cover 50, first selected indicia 46 or selected photo 48, and base 38 all in the assembled and locked state 66, with the alternative pry areas 450 shown, wherein only the key slot 78 can be utilized for removing the cover 50 from the base 38 into the disassembled state 72 via use of the key 70 making removal of the cover 50 from the base 38 very difficult with anything other than use of the key slot 78 and key 70.

Figure 16:
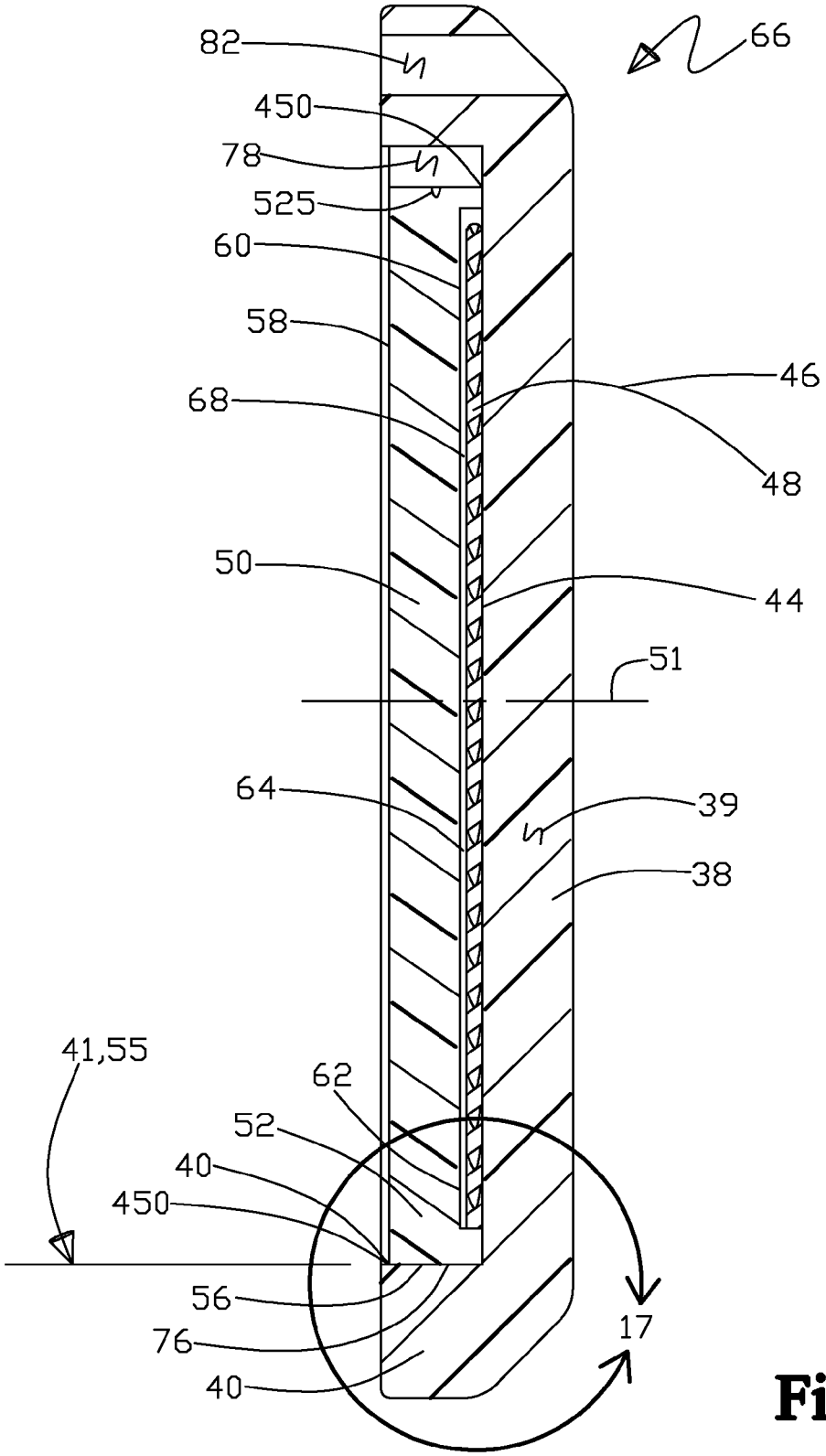
FIG. 16 shows cross section 16-16 from FIG. 7 detailing out the cover, first selected indicia or selected photo, and base all in the assembled and locked state, with the alternative pry areas shown, wherein only the key slot can be utilized for removing the cover from the base in the disassembled state.
Figure 17:
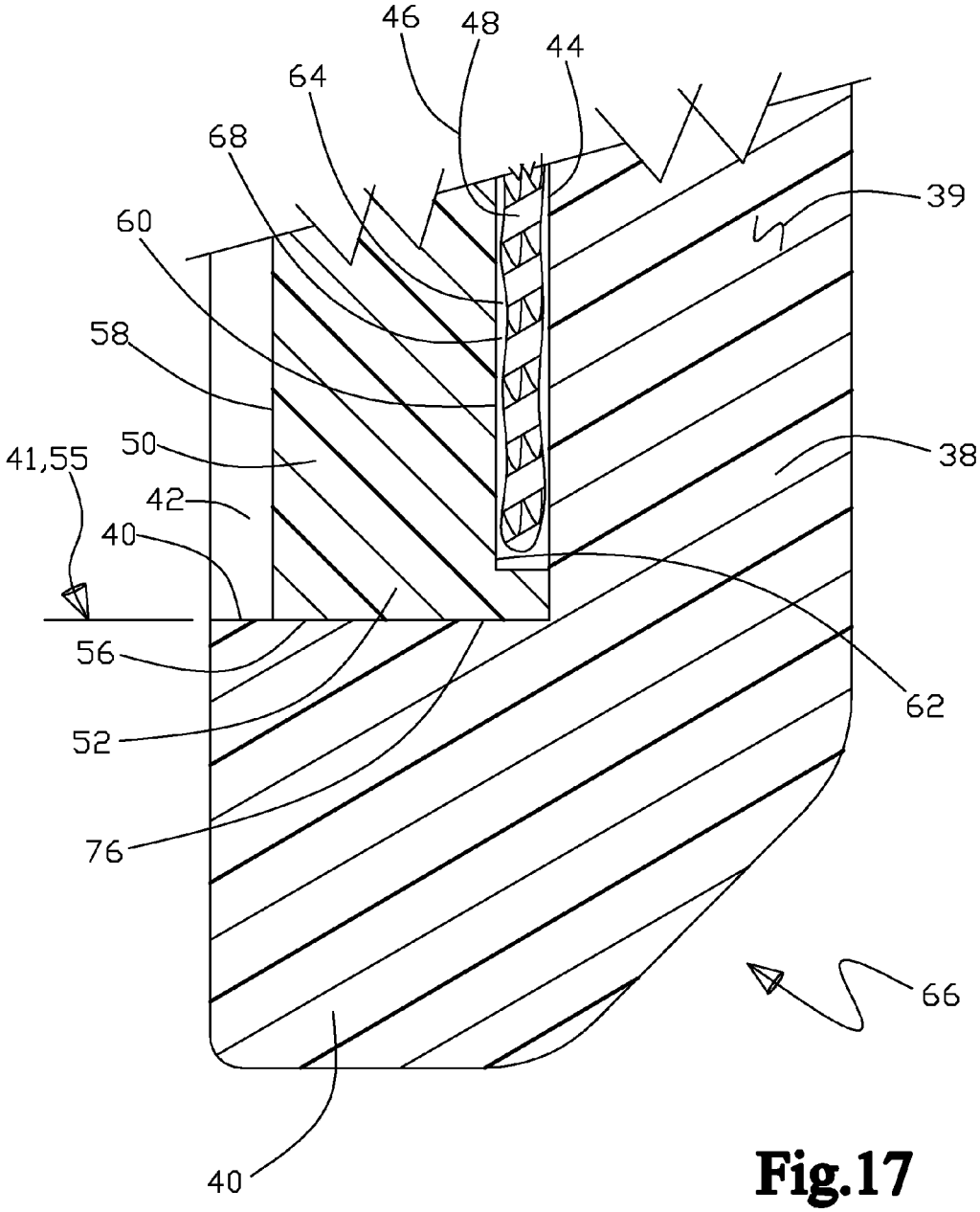
FIG. 17 shows exploded view 17-17 from FIG. 16 detailing out the removable engagement between the cover outer periphery and the base surrounding sidewall opening, with the first selected indicia disposed therebetween.
Figure 18:
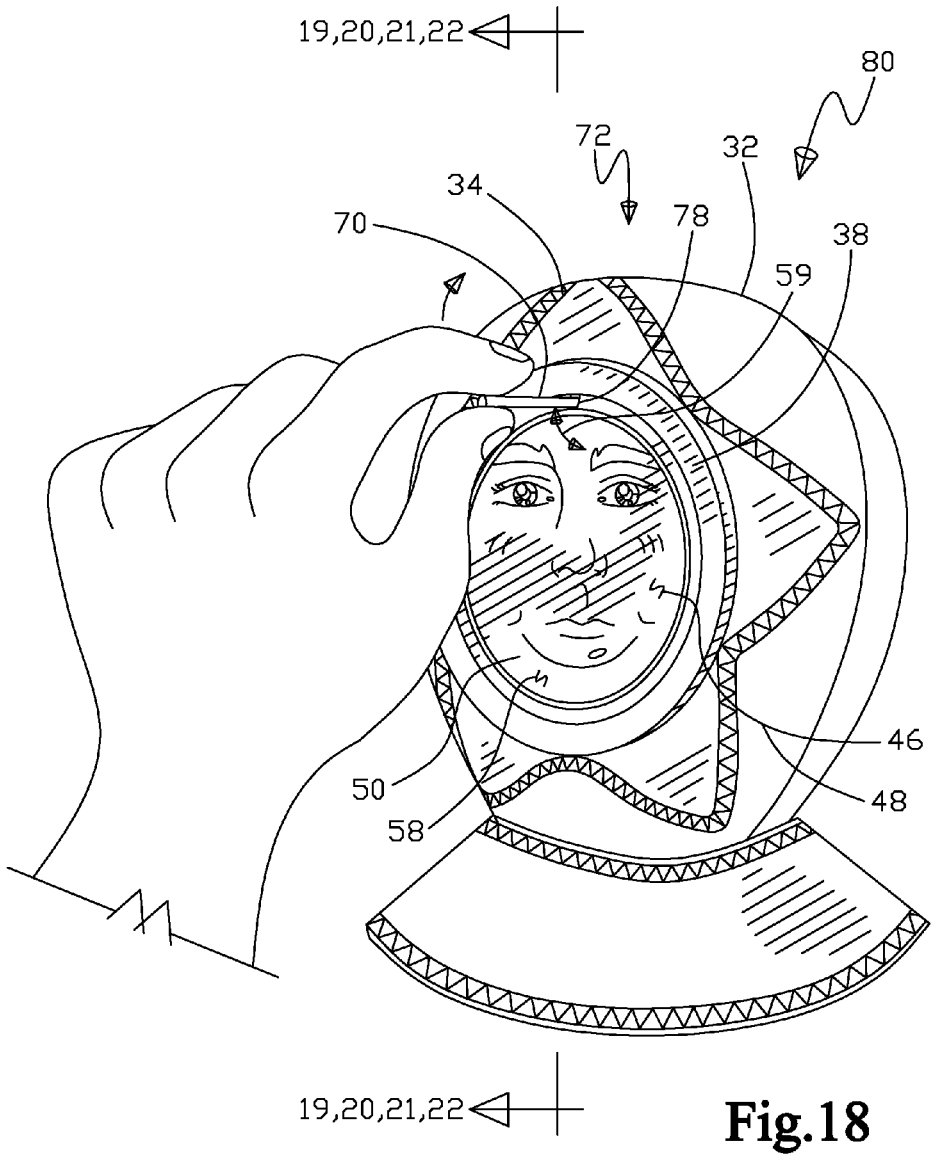
FIG. 18 shows a close-up of the doll head portion with the tool or key being received into the key slot of the cover being prepared for separation of the cover and the base for removal/replacement of the first selected indicia or selected photo.

Next, FIG. 17 shows exploded view 17-17 from FIG. 16 detailing out the removable engagement 56 between the cover outer periphery 53 having the outer diameter 55 and inner diameter 41 of the base 38 surrounding sidewall 40 opening 41, with the first selected indicia 46 disposed therebetween. Continuing, FIG. 18 shows a close-up of the doll head portion 34 with the tool 70 being received into the key slot 78 of the cover 50 being prepared for separation of the cover 50 and the base 38 for removal/replacement of the first selected indicia 46 or selected photo 48. Further, FIG. 19 shows an expanded view of cross section 19-19 from FIG. 18 relating in particular to the tool 70 positioning within the key slot 78 wherein the tool 70 has a pivot point 530 and a recess 525 that the tool 70 is received into in the key slot 78, thereby positioning the tool 70 in its single position to start changing the cover 50 and base 38 from the assembled and locked state 66 to the unlocked state 72 via the indicated tool 70 movement 520.

Figure 19:
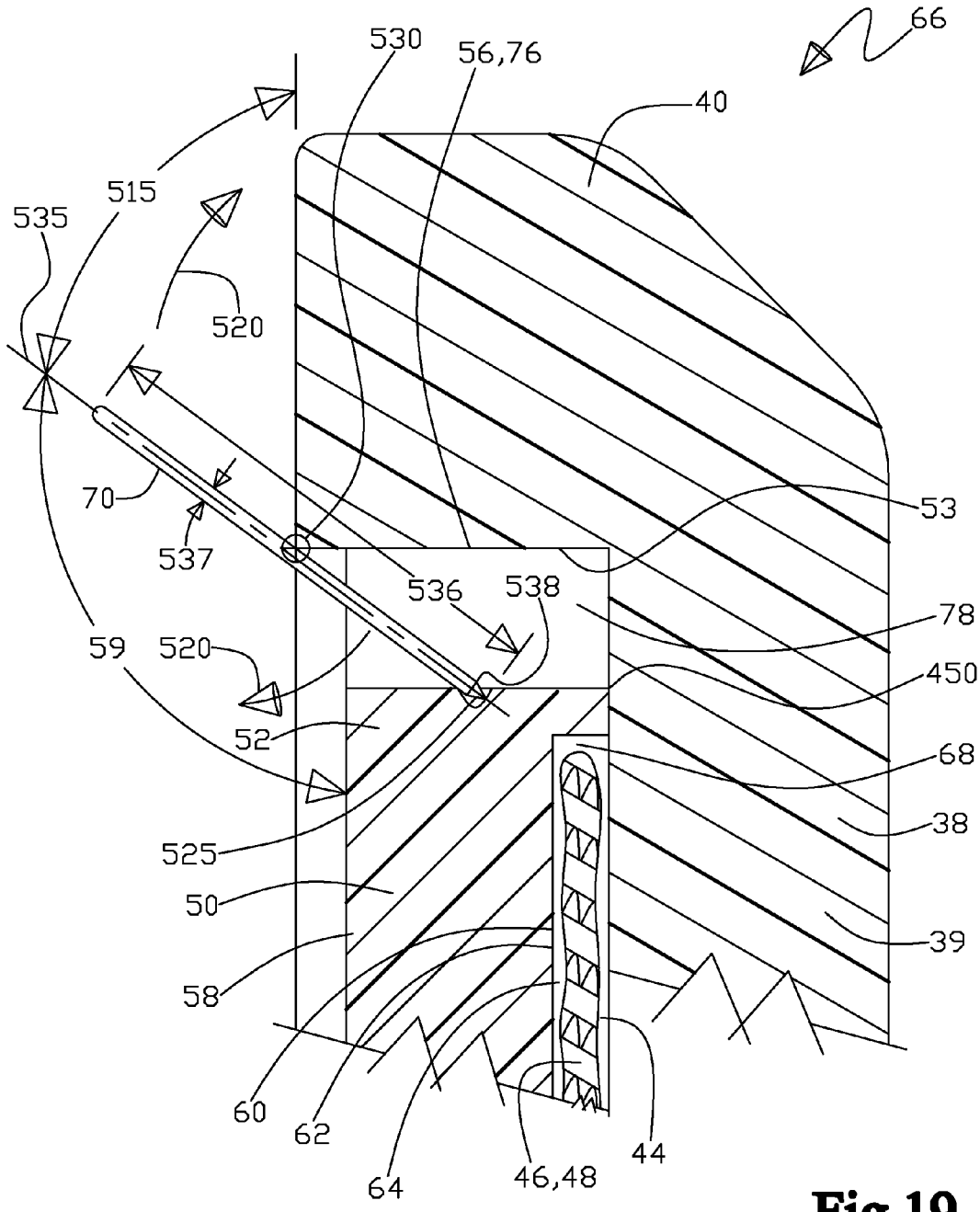
FIG. 19 shows an expanded view of cross section 19-19 from FIG. 18 relating in particular to the tool or key positioning within the key slot wherein the tool or key has a pivot point and a recess that the tool or key in received into in the key slot, thereby positioning the tool or key in its single position to start changing the cover and base from the assembled and locked state to the unlocked state via the indicated tool or key movement.
Figure 20:
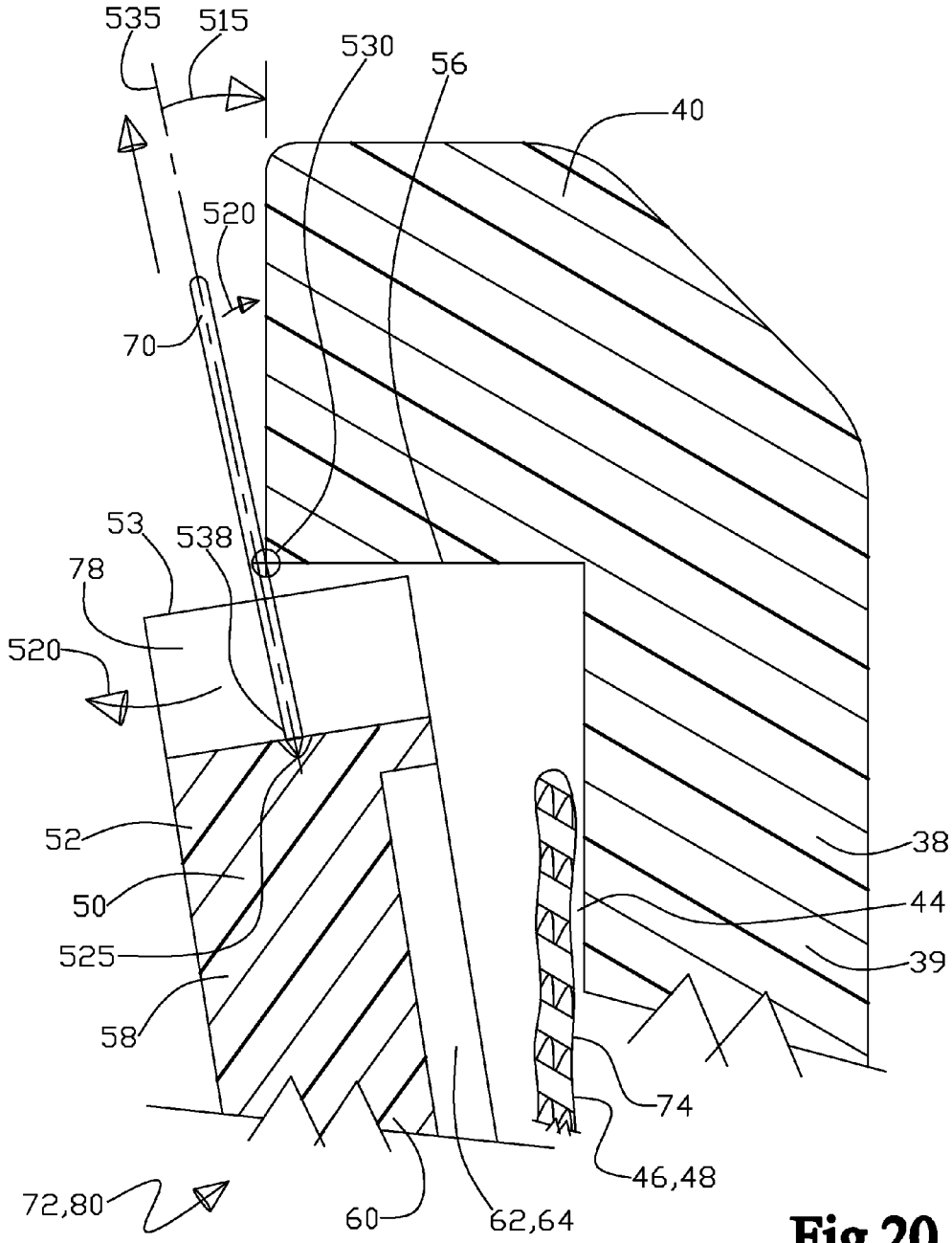
FIG. 20 shows a continuation of FIG. 19 with the tool or key progressing from the assembled and locked state of the cover and base to the separation of the base and cover going into the disassembled and unlocked state while still utilizing the tool or key pivot point and the receiving recess.
Figure 21:
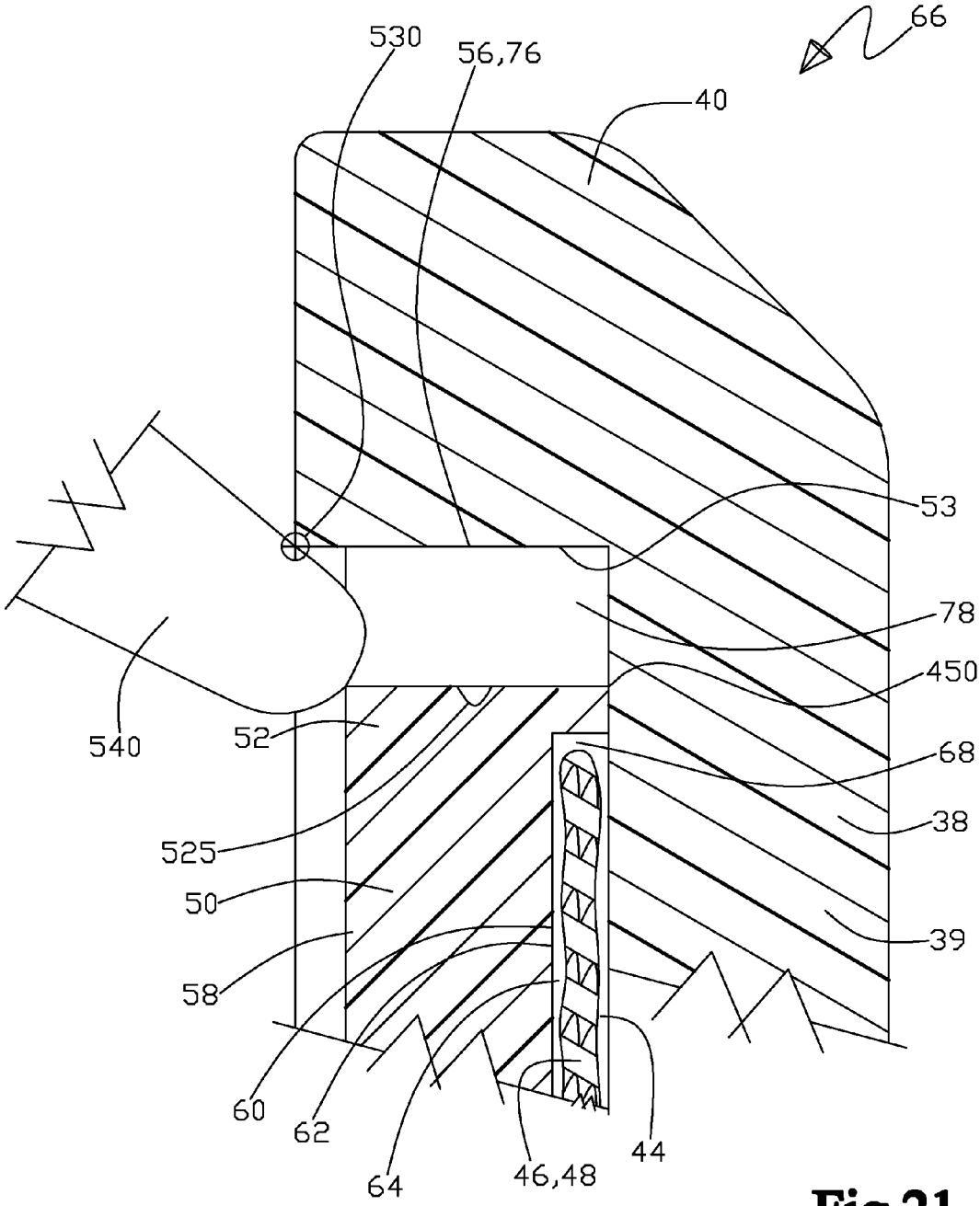
FIG. 21 shows an expanded view similar to FIG. 19 wherein the cover and the base are in the assembled and locked state, however, without the tool or key being used but a common household knife wherein it can be seen that due to the unique depth, width, and recess in the key slot means that the common knife will not be able to separate the cover and the base into the disassembled and unlocked state, thus limiting the ability to separate the cover and base with common household items.

Further, FIG. 20 shows a continuation of FIG. 19 with the tool 70 progressing from the assembled and locked state 66 of the cover 50 and base 38 to the separation of the base 38 and cover 50 going into the disassembled and unlocked state 72 while still utilizing the tool 70 pivot point 530 and the receiving recess 525. Next, FIG. 21 shows an expanded view similar to FIG. 19 wherein the cover 50 and the base 38 are in the assembled and locked state 66, however, without the tool 70 being used but a common household knife 540 wherein it can be seen that due to the unique depth 465, width 505, and recess 525 in the key slot 78, means that the common knife 540 will not be able to separate the cover 50 and the base 38 into the disassembled and unlocked state 72, thus limiting the ability to separate the cover 50 and base 38 with common household items. Continuing, FIG. 22 also shows an expanded view similar to FIG. 19 wherein the cover 50 and the base 38 are in the assembled and locked state 66, however, without the tool 70 being used but a common household screwdriver 545 wherein it can be seen that due to the unique depth 465, width 505, and recess 525 in the key slot 78, means that the common screwdriver 545 will not be able to separate the cover 50 and the base 38 into the disassembled and unlocked state 72, thus limiting the ability to separate the cover 50 and base 38 with common household items.

Figure 23:
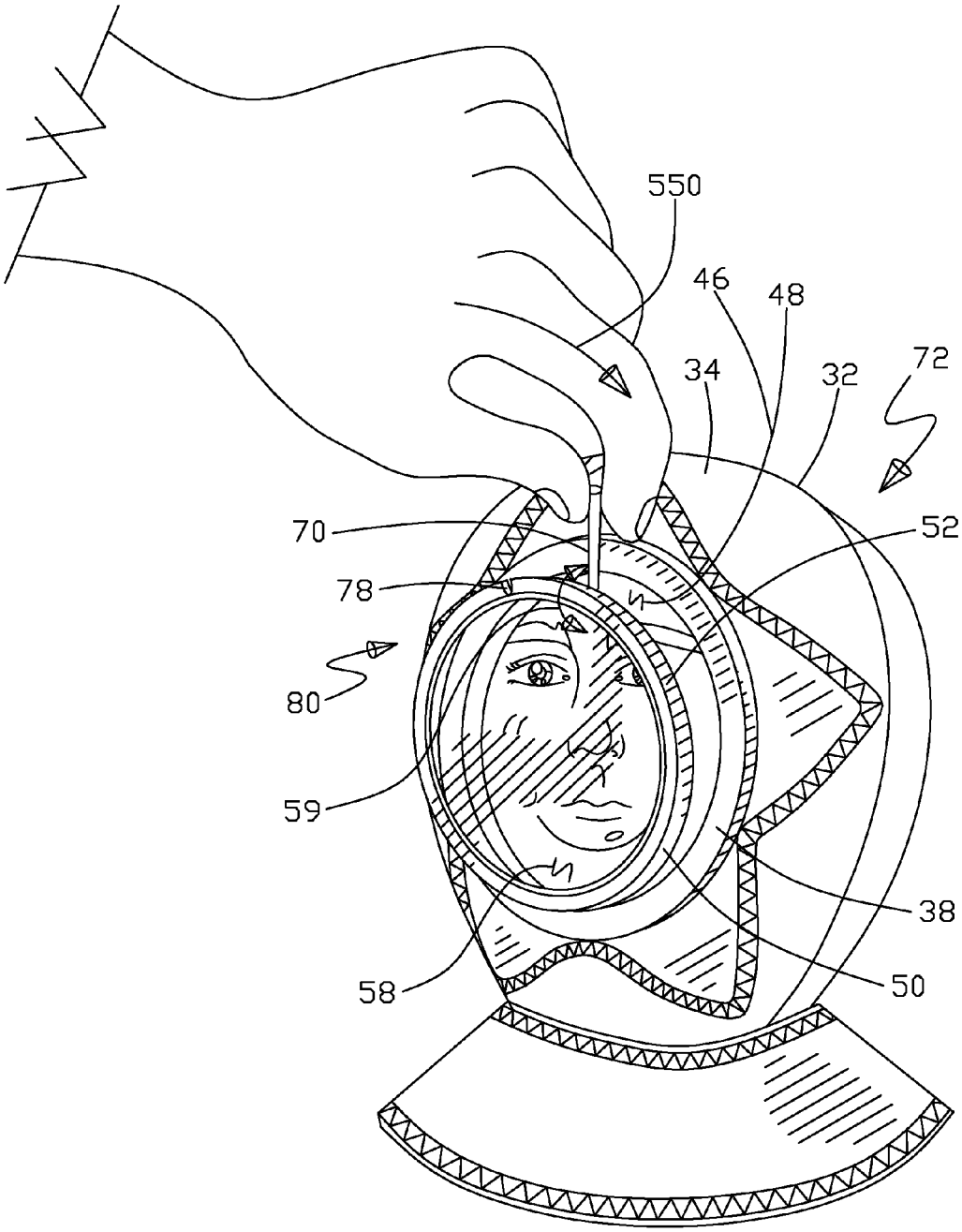
FIG. 23 shows a close-up of the doll head portion with the tool or key being used to effectuate separation of the cover and the base for removal/replacement of the first selected indicia or selected photo, note that once the cover and base are separated the tool or key is selectively moved about the opening of the surrounding sidewall.
Figure 24:
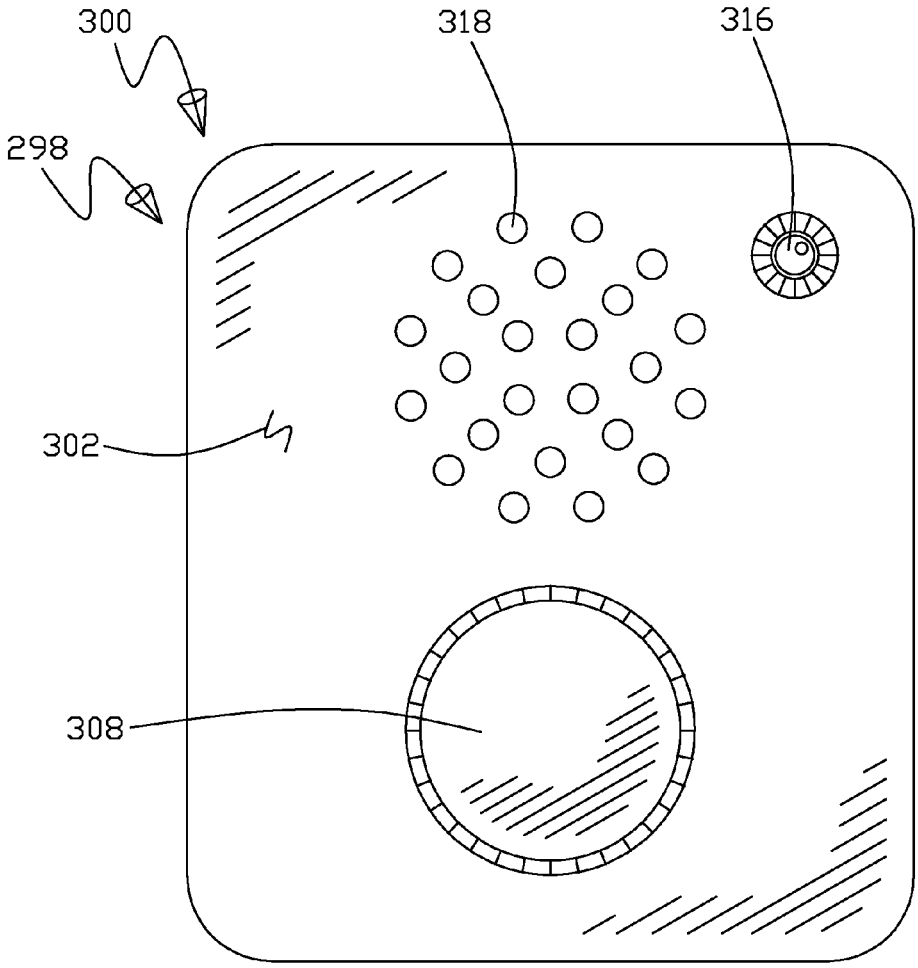
FIG. 24 shows a front view of the means for selectable audio recording of the audio module assembly.
Figure 25:
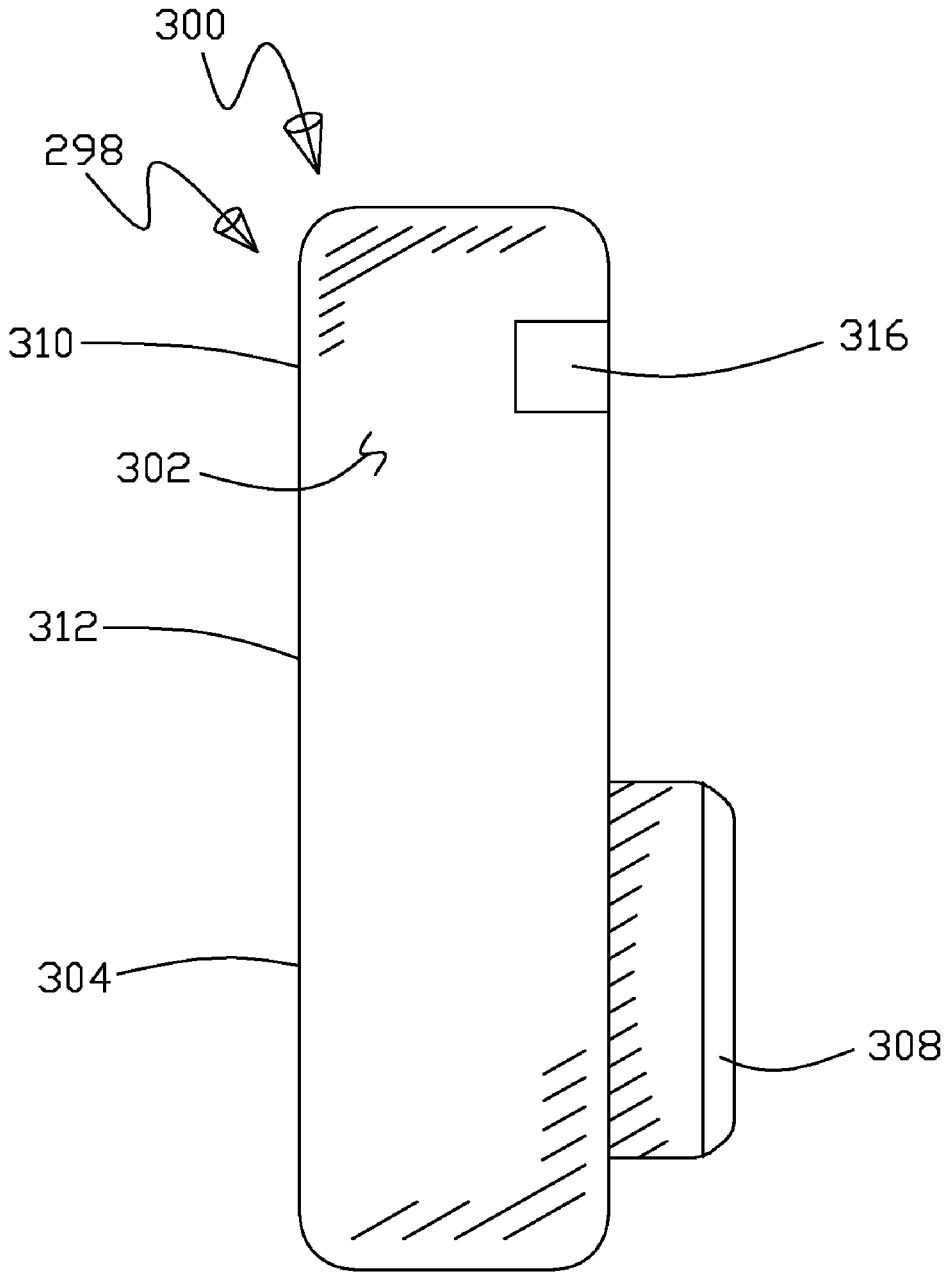
FIG. 25 shows a side view of the means for selectable audio recording of the audio module assembly.
Figure 26:
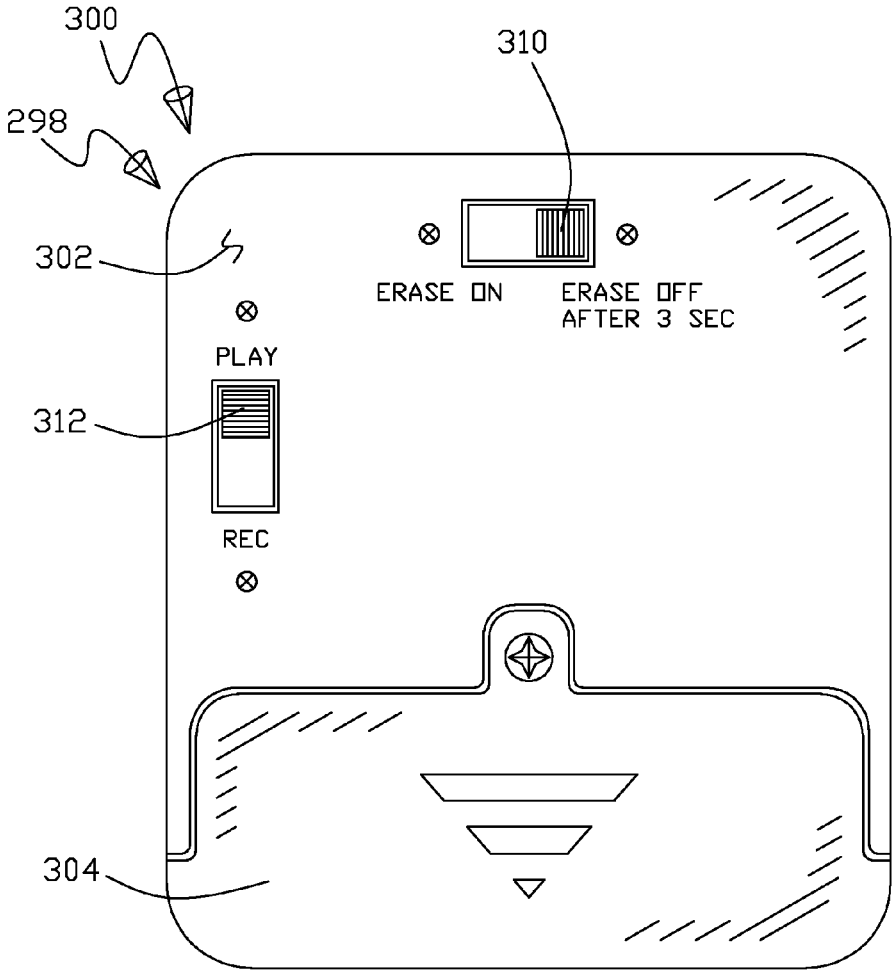
FIG. 26 shows a rear view of the means for selectable audio recording of the audio module assembly.
Figure 27:
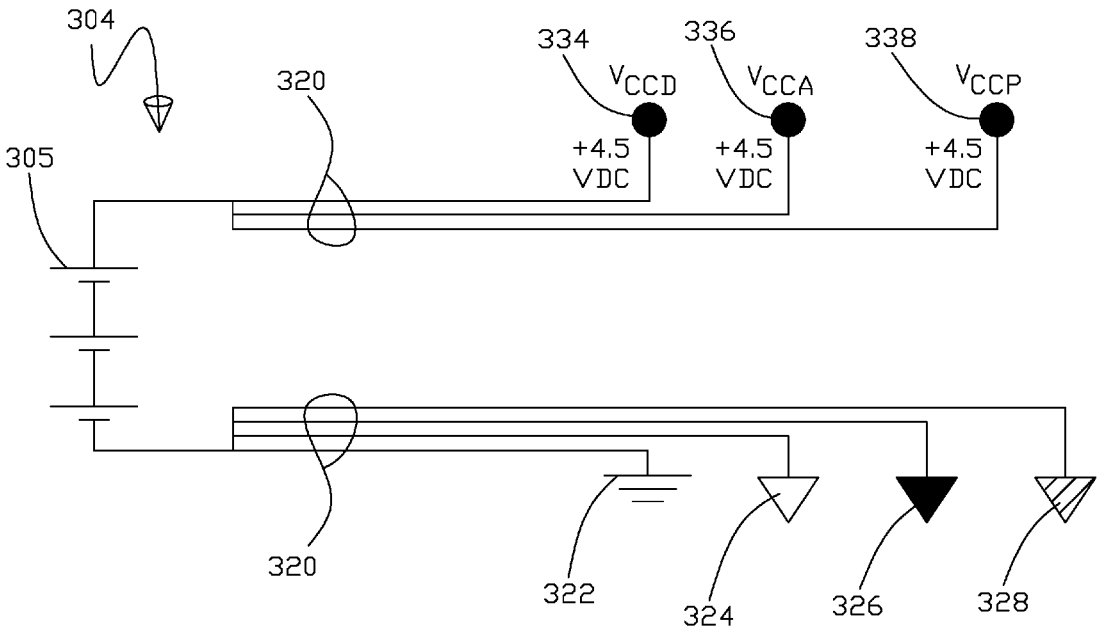
FIG. 27 shows a schematic diagram of the power supply of the audio module assembly.
Figure 28:
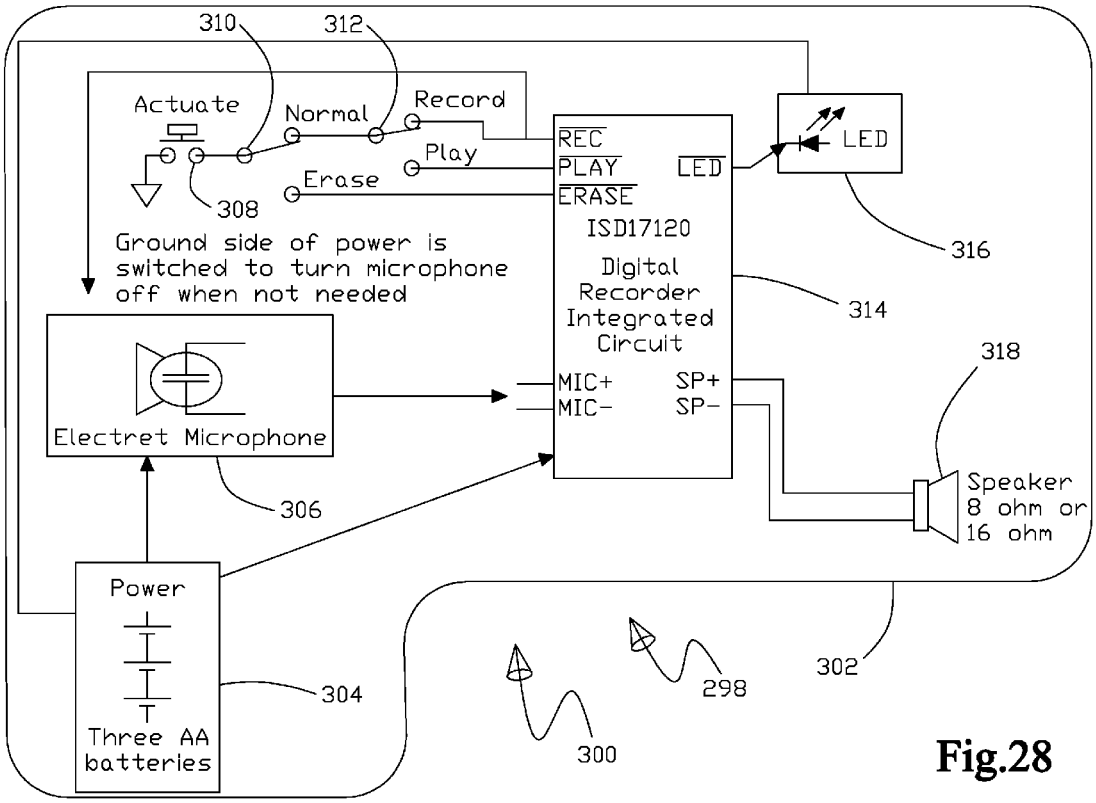
FIG. 28 shows a summary block diagram schematic of the audio module assembly.
Figure 29:
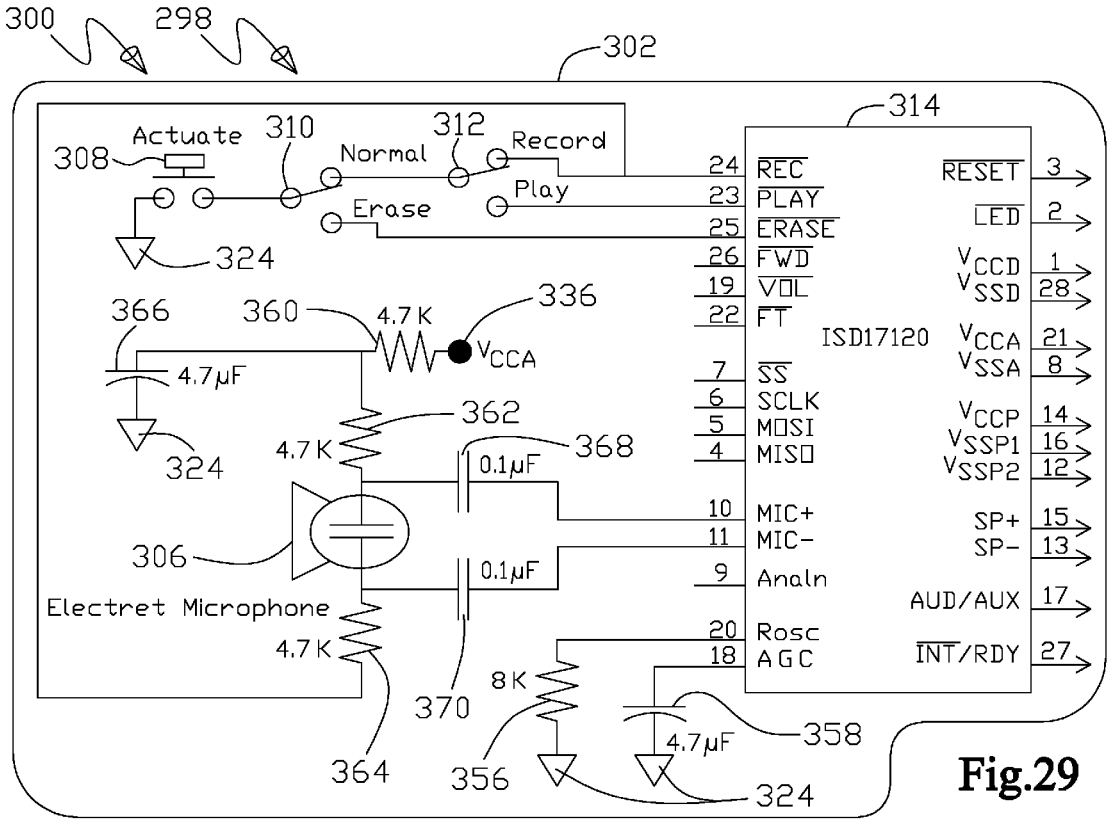
FIG. 29 shows a first portion of the detailed diagram schematic of the audio module assembly.
Figure 30:
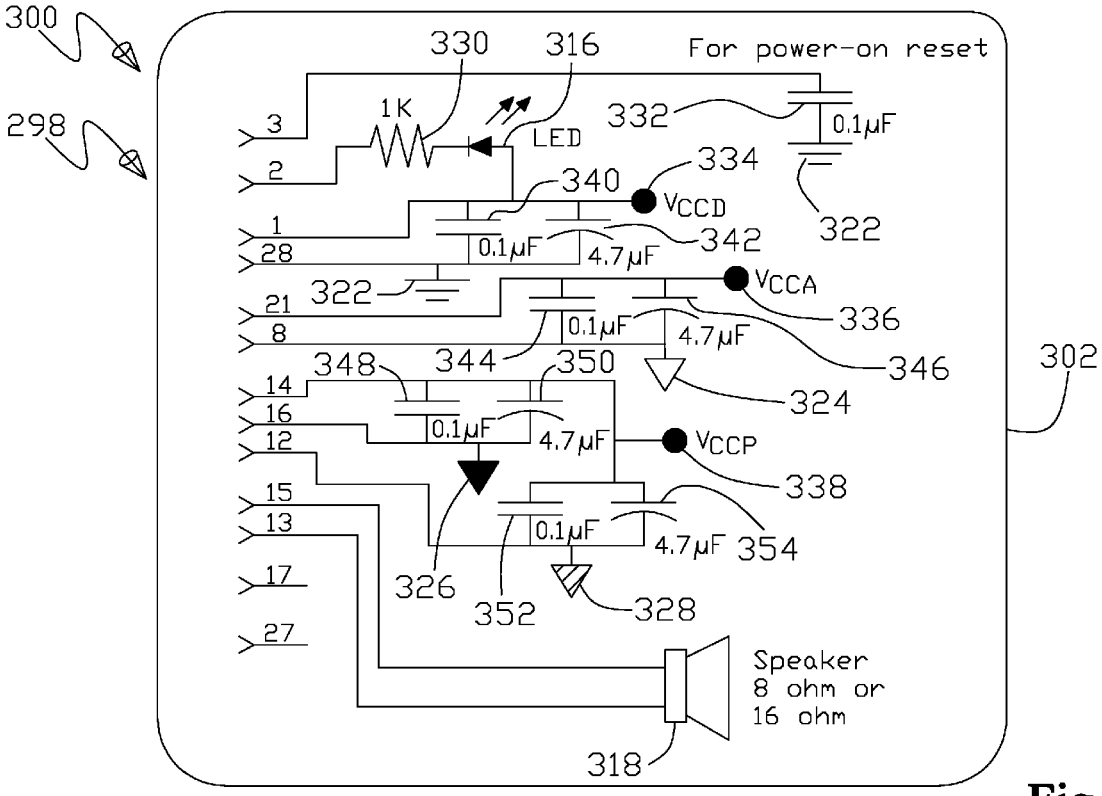
FIG. 30 shows a second portion of the detailed diagram schematic of the audio module assembly.

Continuing, FIG. 23 shows a close-up of the doll 32 head portion 34 with the tool 70 being used to effectuate separation or disengagement 80 of the cover 50 and the base 38 for removal/replacement 74 of the first selected indicia 46 or selected photo 48, FIG. 24 shows a front view of the means 298 for selectable audio recording of the audio module assembly 300, and FIG. 25 shows a side view of the means 298 for selectable audio recording of the audio module assembly 300. Further, FIG. 26 shows a rear view of the means 298 for selectable audio recording of the audio module assembly 300, FIG. 27 shows a schematic diagram of the power supply 304 of the audio module assembly 300, and FIG. 28 shows a summary block diagram schematic of the audio module assembly 300. Next, FIG. 29 shows a first portion of the detailed diagram schematic of the audio module assembly 300 and FIG. 30 shows a second portion of the detailed diagram schematic of the audio module assembly 300.

With initial reference to FIGS. 1-10, the present invention of the figurine 30 that is capable of selectable personalization includes a doll 32 having a head portion 34 and a torso portion 36 and further includes a rigid base 38 that is disposed adjacent to the head portion 34, with the base 38 including a surrounding sidewall 40 extending from a bottom portion 39 to an opening 42. The bottom portion 39 and sidewall 40 of the base 38 defining a first interior portion 44 that is sized and configured to receive a first substantially planar selected indicia 46, as detailed in FIGS. 8 and 16-24. Also included in the figurine 30 is a rigid transparent cover 50 including an outer peripheral portion 52 or more specifically a outer periphery 53 that is adapted to be removably engaged 56 from the sidewall 40 opening 42. The cover 50 having a first side 58 and a second side 60, the second side 60 forming a substantially concave profile 62 to define a second interior portion 64, with the second side 60 adjacent to the base 38 when the outer peripheral portion 52 or more specifically the outer periphery 53 and the opening 42 are manually engaged 56.

The manual engagement 56 forming an assembled and locked state 66 for the base 38 and cover 50, wherein the first interior portion 44 and the second interior portion 64 form a substantially rigid chamber 68 for the first planar selected indicia 46 to be substantially protectively and securely displayed within the substantially rigid chamber 68, as best shown in FIGS. 7, 8, 16, and 17. The substantially rigid chamber 68 is sized and configured such that the first selected indicia 46 does not have to be attached to the base 38 or the cover 50 to help prevent damage to the selected indicia 46, as best shown in FIG. 17. As the removable engagement 56 between the base 38 opening 42 and the cover 50 peripheral portion 52 or cover 50 outer periphery 53 is operational to prevent unauthorized removal of the selected first indicia 46 from the substantially rigid chamber 68 by requiring an independent tool 70 to separate the base 38 and the cover 50 into a disassembled unlocked state 72 to remove or replace 74 the first selected indicia 46 to further enhance security of the assembled state 66, as best shown in FIGS. 18 and 23. Furthermore the first selected indicia 46 can be a selected photograph 48, wherein the substantially rigid chamber 68 is sized and configured to accommodate the selected photograph 48 that is positioned to be displayed through said cover 50 as best shown in FIGS. 7, 8, 16, and 17, by allowing the selected photo 48 to loosely float within the chamber 68 so as to not damage the selected photo 48, by clamping or crimping upon it, in addition to not requiring any means for adhering the selected photo 48 to either the cover 50 to the base 38.

The preferred materials of construction for the doll 32 are a conventional fabric outer cover with a stuffing or filling that is non allergic and mold resistant as is typical for doll 32 construction materials. The preferred materials of construction for the base 38 can be a plastic that is either transparent or opaque, or any other material that is waterproof. The preferred materials for the cover 50 must of necessity be transparent and waterproof, however, outside of that any material would be acceptable. To further optionally have the selectable personalization the doll 32 could further comprise a selected second indicia 86 that is disposed adjacent to the torso portion 36 to further enhance the personalization effect of the figurine by initiating a theme such as selected specific astrological indications 88, as shown in FIGS. 1 and 2, however, other themes not related to astrology could be used also as shown in FIGS. 3-5.

Further to the removable engagement 56 it is preferred to be an interference fit 76, as best shown in FIGS. 16 and 17, wherein the base 38 opening 42 has a periphery size 43, see FIG. 10, that is less than a cover 50 outer periphery size 54, see FIG. 9, when both the base 38 opening 42 and the cover 50 outer periphery 53 are in the disassembled unlocked state 72 as shown in FIGS. 8-13. Note that the amount of interference fit 76 which is the amount that the periphery size 43 is smaller than the periphery size 54 is dependent upon the materials used for the base 38 and cover 50, however, typically being about a 0.2% interference fit 76, wherein the cover 50 periphery distance 54 resulting in a diameter 55 that is about 0.2% (1.002 times) larger than the base 38 opening distance 43 resulting in a diameter 41, being for a typical transparent plastic material, however, as previously stated the amount of interference fit 76 could be less or more than 0.2% depending upon the materials used. The interference fit 76 is preferred due to there being no need for messy adhesives or other types of ancillary fasteners such as hook and loop type, snaps, elastics, and the like.

Continuing, the cover 50 outer peripheral portion 52 further includes a key slot 78, best shown in FIGS. 8, 9, and 11 that is sized and configured to receive the tool 70, as best shown in FIGS. 18 through 23, with the key slot 78 being operational to facilitate the tool 70 disengaging the removable engagement 56 to place the base 38 and the cover 50 into the disassembled unlocked state 72, again as best shown in FIGS. 18 and 23, thus facilitating the removal/replacement 74 of the first selected indicia 46 or selected photo 48. The tool 70 is preferably a small diameter rigid rod such as a small nail. Thus this removal/replacement 74 of the first selected indicia 46 or selected photo 48 has some level of security protecting against unauthorized removal of the selected photo for instance from the base 38 and cover 50 assembly 66, for example in the case of a small child not possessing the tool 70 it would be difficult for the child to remove the selected photo 48 and either damage it or lose it. The preferred method of placing the base 38 adjacent to the head portion 34 is accomplished by a plurality of apertures 82 in the base 38, best shown in FIGS. 7, 8, 10, 13, and 16 that are stitched 84 therethrough to the head portion 34, with the stitching best shown in FIGS. 2 and 4.

As an enhancing option to the selectable personalization the figurine 30 can further optionally comprise a means 298 for a selectable audio recording and playback to further enhance the personalization effect of said figurine by allowing a selected audio recording to be made and played back by a user of the figurine 30, best shown in FIGS. 24-30 for the means 298 for a selectable audio recording and playback and where the means 298 for selectable audio recording and playback is disposed within the torso portion 36 as shown in FIG. 6. Further, the means 298 for selectable audio recording and playback is preferably an electronic audio module 300, as best shown in FIGS. 24-30, wherein the electronic audio module 300 is preferably disposed 400 within the torso portion 36, as best shown in FIG. 6. In controlling the ability of a child for instance to playback only a selected audio recording versus the ability of the user to erase and re-record another selected audio recording, unique positioning of the electronic voice module 300 controls was designed such that the electronic audio module 300 is sized and configured such that an actuation/de-actuation control 308 is a larger high movement button, as best shown in FIGS. 6, 24, and 25, that is operable exterior 402 to the torso portion 36 by merely squeezing 402 the torso portion 36 for the purpose of audio playback operation as shown in FIGS. 24, 25, 28, and 29 for the electronic voice module 300 itself for the user operation 402 in FIG. 6.

Continuing in this same area, the electronic audio module 300 is sized and configured such that an erase control 310 and a record control 312 are only operable by removing the torso portion 404 from the audio module 300 housing 302 to further prevent inadvertent erase and re-record of prior the selected audio recording being made. This is accomplished by sizing and configuring the erase control 310 and the record control 312 to be small recessed controls disposed on the back of the housing 302 as best shown in FIG. 26, thus preventing inadvertent erasing or recording without intentionally removing the audio module 300, by at least exposing the housing back side as shown in FIG. 26 for the user to gain access to the controls 310 and 312, as best shown in FIG. 6, which incidentally allows use of control 308 through the torso portion 36.

Figure 22:
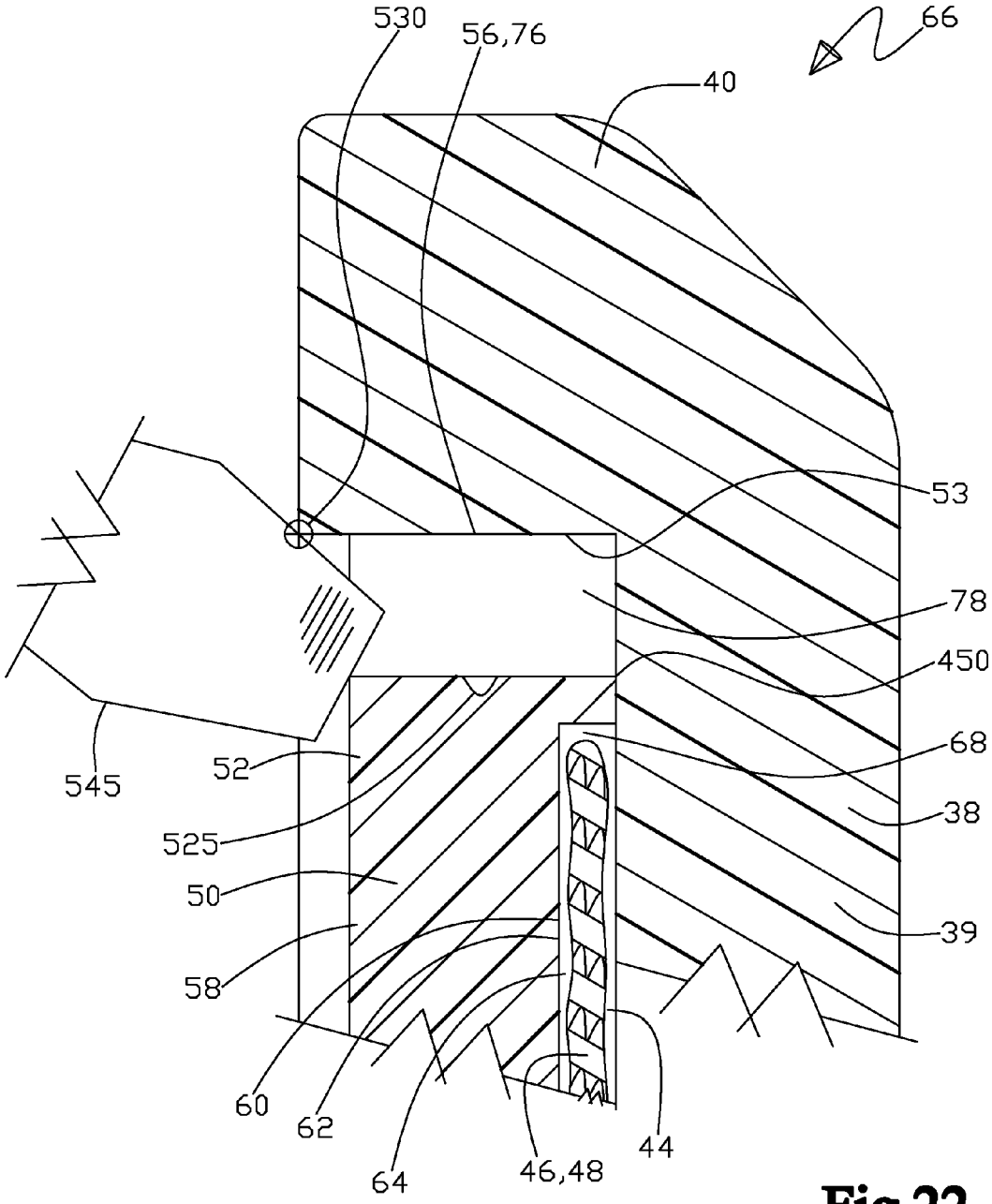
FIG. 22 also shows an expanded view similar to FIG. 19 wherein the cover and the base are in the assembled and locked state, however, without the tool or key being used but a common household screwdriver wherein it can be seen that due to the unique depth, width, and recess in the key slot means that the common screwdriver will not be able to separate the cover and the base into the disassembled and unlocked state, thus limiting the ability to separate the cover and base with common household items.

Further in detailing out the specifics of the audio module 300 and in referring specifically to FIGS. 24-30 and in particular FIGS. 27-30, the audio module 300 includes a programmable integrated circuit chip 314, the actuation/de-actuation 308, erase 310, and record 312 controls, a microphone 306, a speaker 318, and a power supply 304 all contained within a common housing 302. The chip 314 is preferably a Winbond Electronics Corp. multi message single chip for voice record and playback devices model number ISD17120 or substantial equivalent as best shown in FIG. 22, further the programmable integrated circuit chip 314 is desirably capable of at least two hundred and forty (240) seconds selected audio record time, allowing for a more unique and personal audio message to be recorded than is usually available of this type of chip. The power supply is preferably a group of three (3) size AA batteries connected in series 305 providing power at voltage supply 334, 336, and 338 utilizing separate electrical communication lines to minimize electrical noise as indicated by electrical communication 320 as best shown in FIGS. 27, 29, and 30. In addition, to minimize the electrical noise the grounds 322, 324, 326, and 328 are also using separate electrical communication lines indicated by electrical communication 320 as best shown in FIGS. 27, 29, and 30. Further, on the electrolet microphone 306 the actuation/de-actuation control 308 is designed to only have the ground power 324 in electrical communication with the microphone 306 when the microphone is needed for the record mode, thus saving battery 305 power when the microphone 306 is not needed, as best shown in FIGS. 28 and 29. The speaker 318 can be either an eight (8) or sixteen (16) ohm type with the LED 316 being of a conventional type for this application.

The figurine 30 can also be supplied in kit form that is capable of selectable personalization that includes a doll 32, the base 38, cover 50, tool 70, electronic audio module 300, and second selected indicia 86, all as previously described. The kit can also include a pattern sheet emphasize a particular theme especially related to the second selected indicia 86, the pattern sheet for example could mimic FIGS. 1 and 2 for showing placement and orientation for the second selected indicia 86 with an astrological theme 88 as shown in FIGS. 1 and 2, however, many other themes could exist for the second selected indicia 86 such as military, various holiday related, sports activities, careers, outer space, or any other interests that a particular individual may have. This also can be in conjunction with the selected audio recording that can for instance match the person in the selected photo 48, with this being where the set of operating instructions comes in to help give the user ideas on how to match the selected photo with the selected audio recording, i.e. a specific audio recording with a specific astrological sign. Also, a user could use their own photo 48 with the figurine 30 and have a recording of their choice to create a twin aspect of the figurine 30 to themselves.

Interference Fit

In calculating the interference fit as between the base 38 and the cover 50, a number of parameters need to be set forth, please reference FIGS. 12-23. Firstly, the goals of the interference fit must be identified, then the assumptions for the interference calculations, and then the practical analysis for the interference fit considering the use of non-conventional materials in the present invention, i.e. polyvinylchloride (PVC) for the inner diameter 41 for base 38 and PVC for the outer diameter 55 of the cover 50. As with ordinary skill in the art for this area, typically an interference fit is used for like or dissimilar metals that comprise the inner and outer cylinders, wherein the contact pressures are higher in the 1000's of Pounds per Square Inch (PSI) for the purpose of transmitting a torque, restraining an axial force, containing an internal pressure, corrosion resistance, providing strength with corrosion resistance, or any combination of the previously mentioned items. Wherein the current use of the interference fit is unique in being for security purposes to help prevent unauthorized removal of the cover 50 from the base 38 to gain access to the selected indicia 46.

Noting that an interference fit is typically where an inner cylindrical part is manufactured to a larger outside diameter than the inside diameter of the cylinder that it is inserted into, hence the term interference, as the two parts will strain or deform each other at their interface, thus forming a permanently stressed condition, wherein consistent contact pressure exists as between the outside diameter of the inner assembled cylinder and the inside diameter of the outer assembled cylinder. The benefits of the interference fit are many, however, being primarily to effectuate two cylinders to be affixed to one another without the need for welding, screws, bolts, adhesives, threads, and the like. Of course the question would be; how do you get the parts together, other than with a hydraulic ram to axially push the cylinders together with brute force (being generally unacceptable due to potential damage to the cylinders), and the answer is typically in the ordinary skill in the art, wherein the cylinders are made of various metals and through the use of thermal expansion and contraction, wherein the outer cylinder is heated to grow and the inner cylinder is cooled to shrink, thus with the combination of the heat expansion and cooling shrinkage, the manufactured interference between outside diameter of the inner cylinder and the inside diameter of the outer cylinder is not only overcome but exceeded by some small amount, say in the thousandth's of an inch thus creating a clearance to facilitate easy assembly of the two cylinders, and as they both eventually come to an equalized room temperature, the heated cylinder shrinks and the cooled cylinder grows resulting in the desired permanent stress condition at the interference fit interface having contact pressure between the outside diameter of the inner cylinder and the inside diameter of the outer cylinder.

The present invention presents a number of challenges to seeking the benefits of an interference fit as between the base 38 inner diameter 41 and the cover 50 outside diameter 55 primarily being due to the materials used for the interference fit being PVC, as opposed to the conventional use of two like or dislike metal pieces that make-up the interference fit, wherein the principal characteristics of the modulus of elasticity "E" and poissons ration "u" are known along with the thermal coefficients of expansion "α" for metals. Thus, in the present invention with the materials being non-conventional PVC required some trial and error testing not only ascertain the values of E, u, and α, but also the parameters of desired contact pressure that are derived from the coefficient of friction "μ" as between the PVC inner diameter 41 and the outside diameter 55, as basically designing an interference fit as between PVC components is not generally known in the art.

To start, the coefficient of friction "μ" as between the PVC inner diameter 41 and the outer diameter 55 had to be determined from experimentation, as generally available information on coefficients of friction between various materials do not include PVC to PVC, however, many metals, rubber, glass, concrete, and wood are generally known for standard coefficients of friction, however, one must be careful to qualify the coefficient of friction as there are big differences between dynamic and static, wet and dry, and surface finish, so for accuracy, empirical testing may also be done for more commonly mated materials of construction. Thus, an experiment was set up using a flat piece of PVC with the same surface finish as the surface at inner diameter 41 has and outside diameter 55 cut and flattened out to form a flat pattern from its normal cylindrical shape. Next a weight was added to the flat PVC piece that equaled 1 pound for the combination of the PVC flat piece and the weight which would equal the normal force or "N". Thus also assuming that we wanted the static coefficient of friction is a dry-dry condition, the PVC pieces were dry and the lateral force "F" would be measured when the PVC just broke free in going from static to dynamic as the force F is applied to the PVC flat piece. The results were that the force F was determined from testing to be 1 ounce or 0.0625 pounds. Using the equation that the coefficient of friction "μ" is determined from F divided by N, we end up with a coefficient of friction "μ" as between the PVC inner diameter 41 and the outside diameter 55 equaling 0.06 which is considerably less than a typical table value of dry steel on dry steel (static) of about 0.8, meaning that more contact pressure will be needed to effectuate this unique interference fit as between PVC inner diameter 41 and outer diameter 55.

Next, to convert the selected opening force 520 of five (5) pounds force into a contact pressure at the interference fit wherein we will use the previously determined coefficient of friction being 0.06, thus we will calculate the normal force N given the coefficient of friction μ and the lateral force F, thus we divide the lateral force F which is 5 pounds by the coefficient of friction μ being 0.06 which equals 83 pounds, thus this is the compressive force that the outer diameter 55 must at least exert against the inner diameter 41. The 5 pounds force 520 is the force to be placed as against the tool 70, see FIG. 19, for attaining a sufficient force 520 required to make the cover 50 to base 38 interference fit secure against unauthorized removal. Now we convert this to a contact pressure we need to calculate the area at the interference fit, which is inner diameter 41 times Pi "π" times the cover thickness 465 of the interference fit along the longitudinal axis 51. So the calculation is respectively inner diameter 41 being 2.256 inches times 3.14 for π times the cover thickness 465 of 0.1 inches which equals 0.71 square inches being the contact area for the interference fit. To convert this into a contact pressure at the interference fit would equal the total force of 83 pounds divided by the contact area of 0.71 square inches which equals about 113 pounds per square inch as the preferable contact pressure required at the interference fit to be able to create force 520. Noting that force 520 would be actually higher (making the cover 50 and base 38 even more securely attached) as the angling of the cover 50 would slightly increase the contact pressure due to the cover second side 60 becoming a hypotenuse of a triangular relationship of the cover 50 and the base 38, see FIG. 20.

Now that we have the minimum required contact pressure of about 113 pounds per square inch (PSI) we can determine the minimum interference fit required if we have the modulus of elasticity E and the poissons ratio u for the PVC material of the cover 50 and base 38. These properties for the PVC are available, further for the assembly issue as previously discussed that requires the thermal coefficients of expansion of the materials to create the temperature dependent clearance for assembly of the larger outside diameter 55 to fit into the smaller inside diameter 41. Again for PVC thermal coefficients of expansion are available in the art.

The interference equation is basically the summation of deflections of the inner and outer pieces being the cover 50 and the base 38 wherein the deflections are set to be equal to one another and then using the contact pressure at the interference fit the actual deflection is calculated that maintains the contact pressure used in the equation. Basic assumptions that go into the interference equation are that there is no axial loading on either the cover 50 or the base 38 along the longitudinal axis 51, there are no internal or external pressure effects on either the cover 50 or the base 38, there are no temperature effects after the cover 50 and the base 38 are fit together at the interference fit, no centrifugal effects from rotation about the longitudinal axis 51 again after the cover 50 and the base 38 are fit together at the interference fit, and finally no strength is assumed from the head portion 34 on the doll 32. The deflection of the inner diameter 41 is the inverse of the modulus of elasticity E being 1/420,000 multiplied by the quantity ((the radius of diameter 55 being 2.260/2 squared plus the radius of diameter 480 being 2.7/2 squared) divided by the quantity (the radius of diameter 480 being 2.7/2 squared minus the radius of diameter 55 being 2.260/2 squared) plus the poisson ratio being 0.41) which equals 0.00001428 inches squared per pound. The deflection of the outer diameter 55 is the inverse of the modulus of elasticity E being 1/420,000 multiplied by the quantity ((the radius of diameter 55 being 2.260/2 squared) divided by the quantity (the radius of diameter 55 being 2.260/2 squared) minus the poisson ratio being 0.41) which equals 0.000001405 inches squared per pound. The 0.00001428 inches squared per pound is added to the 0.000001405 inches squared per pound equaling 0.00001569 inches squared per pound which is then multiplied by the radius of diameter 55 being 2.260/2 inches and then being multiplied by the contact pressure at the interference fit being 113 pounds per square inch that comes out to equaling 0.004 inches of interference fit diametrically required according to the calculation.

Thus now that we have the preferred interference fit as between the outer diameter 55 and the inner diameter 41 of 0.004 inches, see FIGS. 16, 17, and 19, now we have to account for the manufacturing tolerances of these associated parts, i.e. the outer diameter 55 and the inner diameter 41, such that at the worst case of the tolerances minimizing the interference fit, that we have left at least the minimum interference fit of 0.002 inches, diametrically also admittedly, allowing the interference fit to go in half which proportionally allows force 520 to go to 2.5 pounds which is still adequate to provide a secure attachment as between the cover 50 and the base 38. Continuing, with the tolerances, as the PVC is preferably molded for the cover 50 and the base 38, its manufacturing tolerances will be about in the range of 0.001 inches, thus the outside diameter 55 could be 0.001 inches undersize and the inner diameter 41 could be 0.001 inches oversize resulting in the interference fit going from 0.004 inches to 0.002 inches which would be acceptable as previously discussed. If the tolerances go opposite resulting in an interference fit of 0.006 inches, this would be acceptable also as the force 520 would go to 7.5 pounds and also would be well within the tensile stress limit of PVC at 170 pounds per square inch contact pressure versus 3,000 pounds per square inch and up for the tensile strength of PVC.

In so far as the use of heat and cooling to take advantage of the thermal expansion contraction respectively to facilitate ease of assembly of the cover 50 into the base 38, the need for heating of the base 38 and cooling of the cover 50 can be dispensed with for simplicity, with the assembly as shown FIG. 16 being accommodated by a manual assembly force of about 5 pounds nominally being similar to the force 520 for assembly utilizing an individual's fingers to press the cover 50 into the base 38 as shown in FIG. 16.

Continuing, for the figurine 30 that is capable of selectable secure personalization, wherein the figurine 30 is adapted to lockably retain and protect a displayed substantially planar selected indicia 46 relative to the figurine 30 thereby to protect against unauthorized removal of the displayed selected indicia 46 therefrom, as best shown in FIGS. 1 through 6. The figurine 30 including, the doll 32 having the head portion 34 and the torso portion 36. Further included in the figurine 30 is a rigid base 38 that is attached 84 to the head portion 34, the base including a bottom portion 39, the base also including a surrounding sidewall 40 extending from the bottom portion 39 to an opening 42 that is positioned opposite of the head portion 34 attachment 84, said base bottom portion 39 and the surrounding sidewall 40 including a base outside diameter 480 and the surrounding sidewall 40 including a surrounding sidewall 40 inner diameter opening 41, see FIGS. 13 and 14. The bottom portion 39 and the surrounding sidewall 40 inner diameter 41 opening defining a first interior portion 44 of the rigid base 38 that is sized and configured to receive the substantially planar selected indicia 46, again as best shown in FIGS. 13 and 14.

Further included is a rigid transparent cover 50 that is about a longitudinal axis 51, the cover 50 including an outer peripheral portion 52 having a cover outside diameter 55 that has an interference fit 76 with the surrounding sidewall 40 inner diameter 41, wherein the interference fit 76 is removably engagable, see FIGS. 16 and 17. The interference fit 76 is created by the cover 50 outside diameter 55 being about two-tenths (0.2) percent greater diameter than the surrounding sidewall 40 inner diameter 41 resulting in a contact pressure of about one-hundred thirteen (113) pounds per square inch at the interference fit 76 when the cover 50 outside diameter 55 is forcibly pressed into the surrounding sidewall 40 inner diameter 41 resulting in a secure assembly of the base 38 and cover 50 in an assembled and locked state 66, as best shown in FIGS. 16 and 17. The cover 50 as best shown in FIGS. 9, 11, and 12 having a first side 58 and a second side 60, the second side 60 forming a substantially concave profile 62 defined by a concave inner diameter 470 that is at a concave depth 471 to define a second interior portion 64.

Continuing on the cover 50 as best shown in FIGS. 9, 11, and 12, the second side 60 is adjacent to the bottom portion 39 when the cover 50 outside diameter 55 has the interference fit 76 with the surrounding sidewall 40 inner diameter 41, as shown in FIGS. 14 through 17, placing the cover 50 and base 38 in the assembled and locked state 66, wherein the first interior portion 44 and the second interior portion 64 form a rigid chamber 68 for the first planar selected indicia 46 to be substantially protectively and securely displayed within the rigid chamber 68. The substantially rigid chamber 68 is sized and configured such that the first selected indicia 46 does not have to be attached to the base 38 or the cover 50 to help prevent damage to the selected indicia 46, as the base 38 and cover 50 being specifically the rigid chamber 68 are completely structurally independent of the selected indicia 46.

The cover 50 also includes a key slot 78, see in particular FIGS. 9, 11, 12, and 15, wherein the key slot 78 is disposed within the outer peripheral portion 53, the key slot 78 has a key slot interior 78 defined by a key slot width 505 terminating outwardly at said cover outside diameter 55, a key slot radially inward depth 455 that terminates in a tangential radius 510 spanning the key slot width 505, with the key slot having a depth 465 along the longitudinal axis 51 or the radius axis 511 that equals a cover thickness 465, wherein the tangential radius 510 has a radial axis 511 that is parallel to the longitudinal axis 51. The tangential radius 510 also includes a receiving recess 525 with an indentation depth 527 positioned about midway in depth 526 upon the cover thickness 465, wherein the key slot interior 78 is completely separate and independent from the first interior portion 44 and the second interior portion 64 by virtue of a barrier denoted by dimension 460, as best shown in FIGS. 12 and 15 that ensures complete physical structural separation as between the key slot interior 78 and the first interior portion 44 and the second interior portion 64 or the rigid chamber 68 to completely protect the selected indicia 46 from the use of the key 70 in the key slot interior 78.

Further included is a key 70, see FIGS. 18, 19, 20, and 23, wherein the key 70 includes a key longitudinal axis 535, with the key 70 having a key length 536 that is at least equal to two times the key slot radial depth 455 and the key 70 having a key width 537 that is no more than ninety-five (95) percent of the key slot width 505. The key 70 also has an end portion 538 sized and configured to be received in the receiving recess 525 at the indentation depth 527 being positioned at point 526 along the radial axis 511, wherein the end portion 538 will have a frustoconical tip (male) terminating in a point that matches the receiving recess 525 frustoconical tip (female) profile thus enabling the key 70 to properly pivotally anchor itself in the cover 50 to generate the 5 pounds force 520 pivoting against point 530, see FIGS. 19 and 20. Further to this, in looking at FIGS. 21 and 22, to enhance the security as against unauthorized removal of the selected indicia 46 from the rigid chamber 68, thus it can be seen that the use of common items such as a knife 540 or screwdriver 545 where to be used to try to separate the cover 50 and base 38 into the disassembled state 72 would be very difficult as the key 70 and key slot 78 are matched to one another, thus making access to the selected indicia 46 very difficult without the key 70. Wherein in particular the key end portion 538 fitting into the recess 525, utilizing the pivot 530, with the key 70 having a width 537 sized small to fit into the key slot 78 width 505, and the key having the length 536 to allow enough force 520 to overcome the interference fit 76 as previously described, see FIGS. 19 and 20 in particular.

Wherein operationally the key 70 is inserted into the key slot 78 such that the end portion 538 is positioned within the receiving recess 525 and the key 70 is positioned against the pivot point 530 located on the base surrounding sidewall 40, see FIG. 19. Wherein the force 520 is applied on the key 70 opposite of the receiving recess end 538 toward the surrounding sidewall 40 to overcome the contact pressure of the interference fit 76, wherein the force 520 is in the range of about five (5) pounds resulting in the cover 50 separating from the base 38 into the disassembled unlocked state 72 to remove or replace the first selected indicia 46 to further enhance security of the assembled state 66 by requiring the key 70 being utilized in the key slot 78, thus protecting the selected indicia 46 from unauthorized removal from the figurine 30 without the presence of the key 70.

For the materials of construction for the base 38 and cover 50 and in referencing the interference fit section of the description, it is more convenient for contact pressure purposes to have the materials of construction for the base 38 and cover 50 alike, although this is not necessarily required as different materials for the base 38 and cover 50 can be accommodated in the required contact pressure determination. On the materials of construction for the base 38 and cover 50 transparent plastics are preferred for viewing of the selected indicia 46, availability, and cost. The grouping of preferred transparent plastics would include Acrylics (polymethlamathacrylates), Butyrates (cellulose acetate butyrates), Lexans (polycarbonates), PETGs (glycol modified polyethylene terphthalates), and PVC (polyvinyl chloride), noting that as shown in the interference fit calculation material properties play a role in the final determination of the actual interference fit amount, being the preferred case about four-thousandths (0.004) inches diametrically, wherein the material properties of modulus of elasticity and poisons ratio, determine the interference fit amount for a given contact pressure desired as previously discussed.

Method of Use

Referring in particular to FIGS. 1-8, and 16-26, a method of using a figurine 30 that is capable of selectable secure personalization is disclosed, with the figurine 30 being adapted to lockably retain and protect a displayed substantially planar selected indicia 46 relative to the figurine 30 thereby to protect against unauthorized removal of the displayed selected indicia 46 therefrom, comprising the steps of firstly providing the figurine 30 as previously described.

Secondly a step of grasping the key 70 and thirdly a step of inserting the key 70 into the key slot 78 wherein the key end portion 538 that is sized and configured to be received into the receiving recess 525 indentation 527 at position 526 along the radius axis 511, see FIGS. 12, 19, and 20, wherein the key 70 is inserted firstly into the key slot 78 width 505, see FIG. 15, and further end portion 538 into the receiving recess 525 and moving the key 70 to be positioned against the pivot point 530 wherein the key longitudinal axis 535 is to be at an obtuse angle 59 in relation to the cover first side 58, see FIG. 19. Wherein the key 70 is operational for placing the cover 50 and base 38 into the disassembled unlocked state 72.

Thirdly, a step of pushing the key 70 with the force 520 applied on the key 70 opposite of the receiving recess end 538 toward the surrounding sidewall 40 to overcome the contact pressure of the interference fit 76 resulting in the cover 50 separating from the base 38 into the disassembled unlocked state 72, as shown in FIG. 20. Fourthly, selecting a photo 48 and a fifth step of placing the photo 48 into the first interior portion 44 image side up, see FIGS. 7 and 8. Next, a sixth step of grasping the cover 50 and seventh a step of positioning the cover 50 second side 60 to face the photo 48 image side, again see FIGS. 7 and 8. Continuing, an eighth step of pressing the cover 50 manually toward the base 38 such that the cover 50 outer peripheral portion 53 outside diameter 55 engages the base 38 opening inner diameter 41 forming an assembled and locked state 66 for the base 38 and the cover 50, resulting in the selected photo 48 being operationally protectively and securely displayed through the cover 50, as shown in FIGS. 7, 8, 16, and 17.

Next, a ninth step of removing the torso portion 36 from around electronic audio module 300 for access to the actuation 308/de-actuation 308, record 312, and erase 310 controls, as shown in FIGS. 6, 25, and 26. Further, a tenth step of moving the erase control 310 to off, the record control 312 to record, actuating the actuation control 308 and an eleventh step of speaking into the microphone 306 to make an audio recording for up to about two hundred and forty (240) seconds and then de-actuating the actuation 308/de-actuation 308 control and moving the record control 312 to a play position.

An optional step of a step of sizing the selected photo 48 to be received in the first interior portion 44 by using the cover 50 inner diameter at concave 470 diameter as a template, wherein the photo 48 is sized at the cover inner diameter at concave 470 diameter or less, see FIGS. 16 and 17. Further, another optional step is wherein steps b through i are sequentially repeated to replace the selected photo 48 with another selected photo 48.

CONCLUSION

Accordingly, the present invention of a figurine with selectable audio and visual elements 30 has been described with some degree of particularity directed to the embodiment(s) of the present invention. It should be appreciated, though; that the present invention is defined by the following claims construed in light of the prior art so modifications or changes may be made to the exemplary embodiment(s) of the present invention without departing from the inventive concepts contained therein.

The invention claimed is:

1. A figurine that is capable of selectable secure personalization, said figurine is adapted to lockably retain and protect a displayed substantially planar selected indicia relative to said figurine thereby to protect against unauthorized removal of the displayed selected indicia therefrom, comprising:

(a) a doll including a head portion and a torso portion;

(b) a rigid base that is attached to said head portion, said base including a bottom portion, said base also including a surrounding sidewall extending from said bottom portion to an opening that is positioned opposite of said head portion attachment, said base bottom portion and said surrounding sidewall including a base outside diameter and said surrounding sidewall also including a surrounding sidewall inner diameter opening, said bottom portion and said surrounding sidewall inner diameter opening defining a first interior portion of said rigid base that is sized and configured to receive the substantially planar selected indicia; and (c) a rigid transparent cover that is about a longitudinal axis, said cover including an outer peripheral portion having a cover outside diameter that has an interference fit with said surrounding sidewall inner diameter, wherein said interference fit is removably engagable, said interference fit is created by said cover outside diameter being about two-tenths (0.2) percent greater diameter than said surrounding sidewall inner diameter resulting in a contact pressure of about one-hundred thirteen (113) pounds per square inch at said interference fit when said cover outside diameter is forcibly pressed into said surrounding sidewall inner diameter resulting in a secure assembly of said base and cover in an assembled and locked state, said cover having a first side and a second side, said second side forming a substantially concave profile defined by a concave inner diameter that is at a concave depth to define a second interior portion, with said second side adjacent to said bottom portion when said cover outside diameter has said interference fit with said surrounding sidewall inner diameter in said assembled and locked state, wherein said first interior portion and said second interior portion form a rigid chamber for the first planar selected indicia to be substantially protectively and securely displayed within said rigid chamber, said substantially rigid chamber is sized and configured such that the first selected indicia does not have to be attached to said base or said cover to help prevent damage to the selected indicia, said cover also includes a key slot, wherein said key slot is disposed within said outer peripheral portion, said key slot has a key slot interior defined by a key slot width terminating outwardly at said cover outside diameter, a key slot radially inward depth that terminates in a tangential radius spanning said key slot width, said key slot having a depth along said longitudinal axis that equals a cover thickness, wherein said tangential radius has a radial axis that is parallel to said longitudinal axis, said tangential radius also includes a receiving recess with an indentation depth positioned about midway upon said cover thickness, said key slot interior is separate and independent from said first interior portion and said second interior portion; and (d) a key including a key longitudinal axis, said key having a key length that is at least equal to two times said key slot radial depth and said key having a key width that is no more than ninety-five (95) percent of said key slot width, said key also has an end portion sized and configured to be received in said receiving recess at said indentation depth, wherein operationally said key is inserted into said key slot such that said end portion is positioned within said receiving recess and said key is positioned against a pivot point located on said base surrounding sidewall, wherein a force is applied on said key opposite of said receiving recess end toward said surrounding sidewall to overcome said contact pressure of said interference fit, wherein said force is in the range of about five (5) pounds resulting in said cover separating from said base into a disassembled unlocked state to remove or replace the first selected indicia to further enhance security of said assembled state by requiring said key being utilized in said key slot.

2. A figurine that is capable of selectable secure personalization according to claim 1 wherein said base and said cover are constructed of the same material.

3. A figurine that is capable of selectable secure personalization according to claim 2 wherein said base and said cover are constructed of materials selected from the group consisting essentially of Acrylics (polymethlamathacrylates), Butyrates (cellulose acetate butyrates), Lexans (polycarbonates), PETGs (glycol modified polyethylene terphthalates), and PVC (polyvinyl chloride).

4. A method of using a figurine that is capable of selectable secure personalization, said figurine is adapted to lockably retain and protect a displayed substantially planar selected indicia relative to said figurine thereby to protect against unauthorized removal of the displayed selected indicia therefrom, comprising the steps of:

(a) providing a figurine that includes a doll having a head portion and a torso portion, also a rigid base that is attached to said head portion, said base including a bottom portion, said base also including a surrounding sidewall extending from said bottom portion to an opening that is positioned opposite of said head portion attachment, said base bottom portion and said surrounding sidewall including a base outside diameter and said surrounding sidewall including a surrounding sidewall inner diameter opening, said bottom portion and said surrounding sidewall inner diameter opening defining a first interior portion of said rigid base that is sized and configured to receive the substantially planar selected indicia, further included is a rigid transparent cover that is about a longitudinal axis, said cover including an outer peripheral portion having a cover outside diameter that has an interference fit with said surrounding sidewall inner diameter, wherein said interference fit is removably engagable, said interference fit is created by said cover outside diameter being about two-tenths (0.2) percent greater diameter than said surrounding sidewall inner diameter resulting in a contact pressure of about one-hundred thirteen (113) pounds per square inch at said interference fit when said cover outside diameter is forcibly pressed into said surrounding sidewall inner diameter resulting in a secure assembly of said base and cover in an assembled and locked state, said cover having a first side and a second side, said second side forming a substantially concave profile defined by a concave inner diameter that is at a concave depth to define a second interior portion, with said second side adjacent to said bottom portion when said cover outside diameter has said interference fit with said surrounding sidewall inner diameter in said assembled and locked state, wherein said first interior portion and said second interior portion form a rigid chamber for the first planar selected indicia to be substantially protectively and securely displayed within said rigid chamber, said substantially rigid chamber is sized and configured such that the first selected indicia does not have to be attached to said base or said cover to help prevent damage to the selected indicia, said cover also includes a key slot, wherein said key slot is disposed within said outer peripheral portion, said key slot has a key slot interior defined by a key slot width terminating outwardly at said cover outside diameter, a key slot radially inward depth that terminates in a tangential radius spanning said key slot width, said key slot having a depth along said longitudinal axis that equals a cover thickness, wherein said tangential radius has a radial axis that is parallel to said longitudinal axis, said tangential radius also includes a receiving recess with an indentation depth positioned about midway upon said cover thickness, said key slot interior is separate and independent from said first interior portion and said second interior portion, further included is a key including a key longitudinal axis, said key having a key length that is at least equal to two times said key slot radial depth and said key having a key width that is no more than ninety-five (95) percent of said key slot width, said key also has an end portion sized and configured to be received in said receiving recess at said indentation depth, wherein operationally said key is inserted into said key slot such that said end portion is positioned within said receiving recess and said key is positioned against a pivot point located on said base surrounding sidewall, wherein a force is applied on said key opposite of said receiving recess end toward said surrounding sidewall to overcome said contact pressure of said interference fit, wherein said force is in the range of about five (5) pounds resulting in said cover separating from said base into a disassembled unlocked state to remove or replace the first selected indicia to further enhance security of said assembled state by requiring said key being utilized in said key slot, said figurine also includes an electronic audio module that is disposed within said torso portion, said electronic audio module is sized and configured such that an actuation/de-actuation control is operable exterior to said torso portion by merely squeezing said torso portion for the purpose of audio playback operation, wherein an erase control and a record control are only operable by removing said torso portion from said audio module to further prevent inadvertent erase and re-record of prior said selected audio recording, said electronic audio module is constructed of circuitry that includes a programmable integrated circuit chip, said actuation/de-actuation, erase, and record controls, a microphone, a speaker, and a power supply all contained within a common housing, wherein said programmable integrated circuit chip is capable of at least two hundred and forty (240) seconds selected audio record time, said doll further includes a selected second indicia that is disposed adjacent to said torso portion to further enhance the personalization effect of said figurine, a pattern sheet adapted to indicate a position of said selected second indicia relative to said torso portion, and operating instructions for use of said key and said electronic audio module;

(b) grasping said key;

(c) inserting said key into said key slot wherein said key end portion that is sized and configured to be received into said receiving recess is inserted firstly into said key slot and further into said receiving recess and moving said key to be positioned against said pivot point wherein said key longitudinal axis is to be at an obtuse angle in relation to said cover first side, wherein said key is operational for placing said cover and base into said disassembled unlocked state;

(d) pushing said key with said force applied on said key opposite of said receiving recess end toward said surrounding sidewall to overcome said contact pressure of said interference fit resulting in said cover separating from said base into said disassembled unlocked state;

(e) selecting a photo;

(f) placing the photo into said first interior portion image side up;

(g) grasping said cover;

(h) positioning said cover second side to face the photo image side;

(i) pressing said cover manually toward said base such that said cover outer peripheral portion outside diameter engages said base opening inner diameter forming an assembled and locked state for said base and said cover, resulting in the selected photo being operationally protectively and securely displayed through said cover;

(j) removing said torso portion from around electronic audio module for access to said actuation/de-actuation, record, and erase controls;

(k) moving said erase control to off, said record control to record, actuating said actuation control; and (l) speaking into said microphone to make an audio recording for up to about two hundred and forty (240) seconds and then de-actuating said actuation/de-actuation control and moving said record control to a play position.

5. A method for using a figurine that is capable of selectable personalization according to claim 4 further comprising a step of sizing the selected photo to be received in said first interior portion by using said cover inner diameter at concave diameter as a template, wherein the photo is sized at said cover inner diameter at concave diameter or less.

6. A method for using a figurine that is capable of selectable personalization according to claim 4 wherein steps b through i are sequentially repeated to replace the selected photo with another selected photo.

* * * * *